US010342315B2

(12) United States Patent
Maehr

(10) Patent No.: US 10,342,315 B2
(45) Date of Patent: Jul. 9, 2019

(54) ENHANCED LIPSTICK TUBES

(71) Applicant: Hubert Maehr, Wayne, NJ (US)

(72) Inventor: Hubert Maehr, Wayne, NJ (US)

(73) Assignee: Hubert Maehr, Wayne, NJ (US)

( * ) Notice: Subject to any disclaimer, the term of this patent is extended or adjusted under 35 U.S.C. 154(b) by 0 days.

(21) Appl. No.: 14/545,391

(22) Filed: Apr. 29, 2015

(65) Prior Publication Data

US 2016/0316887 A1 Nov. 3, 2016

(51) Int. Cl.

| | |
|---|---|
| ***A44C 15/00*** | (2006.01) |
| ***A45D 40/18*** | (2006.01) |
| ***A45D 40/06*** | (2006.01) |
| ***A44C 1/00*** | (2006.01) |
| ***A44C 25/00*** | (2006.01) |
| *A45D 40/00* | (2006.01) |

(52) U.S. Cl.

CPC ..... *A45D 40/18* (2013.01); *A44C 1/00* (2013.01); *A44C 15/005* (2013.01); *A44C 25/002* (2013.01); *A45D 40/06* (2013.01); *A45D 2040/0006* (2013.01); *A45D 2040/0012* (2013.01)

(58) Field of Classification Search

CPC ..... A44C 25/002; A44C 15/005; A44C 1/00; A45D 2040/0012; A45D 2040/0006

USPC ..... 63/1.14

See application file for complete search history.

(56) References Cited

U.S. PATENT DOCUMENTS

| | | | | | |
|---|---|---|---|---|---|
| D152,216 | S * | 12/1948 | Quethera | 132/286 | |
| 5,067,836 | A * | 11/1991 | Khan | A45D 40/06 | 401/195 |
| 5,244,135 | A * | 9/1993 | Nelson | A45F 5/00 | 224/257 |
| 5,390,510 | A * | 2/1995 | Tirio-Cloonan | A44C 15/002 | 132/294 |
| 8,136,686 | B2 * | 3/2012 | Schlatter | A44B 15/005 | 220/212.5 |
| 2006/0113345 | A1 * | 6/2006 | Zoullas | A45F 5/00 | 224/600 |
| 2006/0227539 | A1 * | 10/2006 | Wu | A44C 15/0015 | 362/157 |

(Continued)

FOREIGN PATENT DOCUMENTS

| | | | | |
|---|---|---|---|---|
| CN | 204682727 U | * | 10/2015 | |
| DE | 29701928 U1 | * | 6/1997 | A44C 15/003 |

(Continued)

*Primary Examiner* — Jennifer C Chiang

(57) ABSTRACT

A lipstick tube that can be worn as an attachment to wearable object, such as a necklace, with the intermediacy of a coupling system wherein the lipstick tube is readily connect and disconnect to and from the necklace, and wherein the resulting arrangement is tailored to athletic and outdoor activities with built-in resistance of the tube toward loss of the lipstick by unintentional pulling, or wherein the arrangement is intended as an ornate display of charm and grace and targeted primarily to female users where elegance and practicality is supported by the coupling system. The choice tubes can be provided with refill capabilities to encourage use of valuable construction materials, to guarantee their value and usefulness over a long lifetime, to enlarge the repertoire of available lipstick colors and chemical compositions for the user, and to encourage eco-friendliness.

8 Claims, 16 Drawing Sheets

(56) References Cited

U.S. PATENT DOCUMENTS

| | | | | |
|---|---|---|---|---|
| 2008/0245104 | A1* | 10/2008 | Steele | A44C 5/003 63/1.12 |
| 2009/0317169 | A1* | 12/2009 | Limongi | A45D 40/065 401/68 |
| 2011/0072850 | A1* | 3/2011 | Keyes | A44C 25/002 63/1.14 |

FOREIGN PATENT DOCUMENTS

| | | | | |
|---|---|---|---|---|
| JP | 09289919 | A | * | 11/1997 |
| JP | 2011147741 | A | * | 8/2011 |

* cited by examiner

ENHANCED LIPSTICK TUBES

CROSS-REFERENCE TO RELATED APPLICATIONS

Not applicable

FEDERALLY SPONSORED RESEARCH

Not applicable

SEQUENCE LISTING OF PROGRAM

Not applicable

FIELD OF THE INVENTION

This embodiment relates to lipstick tubes that are practical, economical and eco-friendly, and to means that enhance their ease of access, utility, and their decorative appeal.

BACKGROUND AND DISCUSSION OF PRIOR ART

The evolution of today's lipstick extends over a long time period. The Sears Roebuck catalog first offered rouge for lips and cheeks already by the late 1890s. At that time lipstick was applied with a brush, but by 1915 lipstick was sold in cylindrical metal containers. In 1923, the first swivel-up tube was patented. Throughout the 1920s and 30s, many more lipstick tubes were patented in the United States, all with the same basic function: the container would swivel, twist or push, a tube of lipstick from a hollow cylinder assembly. Thanks to the continuous development effort we have now arrived at the stage of the modern lipstick tube that propelled "lipstick" to the most popular cosmetic in the world.

Most of the contemporary lipstick tubes contain the same basic parts. FIG. 1 shows an oblique rendition of a complete lipstick tube and FIG. 1A details the components, all arranged along a common longitudinal axis. In coaxial and concentric alignment, sleeves 05, 10, and 14 are referred to as the sleeve assembly. The cylindrical cup 01 serves as the receptacle for the lipstick 02 and features seal- and friction modifying rings 04 and two diametrically opposed protuberances or lugs 03 extending outward. The tubular inner sleeve 05 extends to the base 06, referred to as the rotator, to which sleeve 05 is firmly attached. Cup 01 resides inside of 05 and the lugs 03 extend through the slots 07, thus permitting longitudinal movement of 01 within 05. The short angled extensions of the vertical slots 07 complete a Z-configuration to limit the movement of 01 within sleeve 05. A tubular central sleeve 10 contains two identical inner helical grooves 11 which are diametrically offset with respect to each other. The grooves 11 are of sufficient depth to accept the lugs 03 as they extend though the slots 07 of the inner tube 05. A circular groove 08 in the solid part of the rotator accepts the toroidal extension 12 at the bottom of sleeve 10 and functions as a track allowing free circular movement of 10 within 06. It is usually required to fortify the physical integrity of 10 with an additional sleeve 14, caressing 10 tightly thus forming an integrated unit that moves as an entity and is referred to as sleeve 10/14. Examples of vertical sections views of the upper portions of common wall profiles and wall interactions of sleeves 05 with 10/14 are shown in FIGS. 1B to 1E, but the views are limited to the left sides of the wall profiles wherein the pomade would be extrudable in the direction of the upwardly projecting end. FIG. 1B shows sleeve 10/14 with a rabbet cut, designed to rotatably engage with sleeve 05 via a rim, lip, or toroid that extends from 05 peripherally toward the wall of the sleeve 10/14 and further into the rabbet cut of that sleeve. In FIG. 1C, the rabbet cut, as seen in FIG. 1B, is changed to a groove cut; in FIG. 1D the upper perimeter of sleeve 10/14, referred to as the projection of the groove cut, is extended further to cover the upper surface of 05 entirely; in FIG. 1E the inner sleeve 05 provides a rim directed toward the outside to cover the upper perimeter of 10/14 from the opposite direction.

The purpose of these interconnections between inner sleeve 05 and central sleeve 10/14 is to prevent longitudinal displacement of the central sleeve with respect to the inner sleeve. Regardless of the longitudinal restriction means imposed on sleeves 10/14 by tongues and grooves, or by any other such restrictive elements, the tolerances of the dimensions of 05 and 10/14 have to allow free rotational movement with respect to each other. The primary packaging is completed with the protective cap 17.

Since sleeve 05 is rigidly attached to base 06, rotation of 06 transfers a torque to the cup 01 through the lugs 03 due to their engagements with the slots 07 in sleeve 05 and the helical grooves 11 in sleeve 10. This torque causes helical movement of 01 relative to sleeve 10/14 while 10/14 is held immobile by holding it with the fingers. In addition to providing mechanical stability, the added sleeve 14 can also enhance the décor of the assembly. The decorative band 15 can function as a seat for the protective cover cap 17 which is usually friction-fitted over 14 and where the raised band 16 contributes to a tight fit. Prominent examples of significant refinements of the tube mechanism are listed below.

U.S. Pat. No. 4,984,919: Lipstick-type cosmetic case,
U.S. Pat. No. 5,234,275: Holder for a stick of cosmetic material,
U.S. Pat. No. 5,560,727: Lipstick case,
U.S. Pat. No. 5,779,664: Cosmetic container having an insert sleeve to improve tightness and rotational characteristics,
U.S. Pat. No. 5,813,421: Lipstick swivel mechanism,
U.S. Pat. No. 5,888,003: Cosmetic container having an inner sleeve for creating torque,
U.S. Pat. No. 5,899,621: Lipstick swivel mechanism with brake function,
U.S. Pat. No. 5,979,468: Tube for lipstick and the like,
U.S. Pat. No. 6,139,208: Lipstick tube,
U.S. Pat. No. 7,753,608: Lipstick case with cam mechanism,
US 2006/0099024: Mechanism of rotating lipstick case,
US 2007/0059088: Lipstick mechanism,
US 20090032424: Individual and universal lipstick tube cases, and
US 20130058700: Press lipstick assembly.

Lipsticks fall basically into two general categories; one of them is employed primarily for protecting and assuaging the lips, especially for use in outdoor activities, while the other is mainly for cosmetic purposes. Corresponding to these applications, there are two types of lipstick tubes. The first category is usually served by inexpensive tubes, typically made of plain plastic materials with a simple screw assembly for the lipstick advancement, the latter is primarily the realm of female users with emphasis on elegance and is often served by elaborate and ornate designs wherein the swivel mechanism is most common.

In spite of the long development period of the primary packaging, a number of shortcomings prevail. Lipsticks are usually located in pockets, at the bottom of purses, in drawers or in backpacks so that ready availability is compromised. In an early attempt to address this problem, one of the first metal tubes for lip pomade in 1925 by Roger & Gallet was equipped with a large metal ring, conceivably designed for attachment to an object to facilitate its retrieval and some of today's inexpensive lip balm tubes have an orifice in the cap obviously intended for a similar purpose. Any connection at a tube cap, however, can generate a precarious situation. The cap is usually connected to the lipstick tube body by simple friction fit so that an unintended pull on the tube body, especially during physical activities, can cause disengagement of the tube elements and possible loss of the lipstick. Even intentional disengagement of the lipstick tube from the cap leaves the user with the lipstick in hand and accidental dropping may result in the loss of the lipstick, an event that is not too uncommon during hibernal sport activities when gloves are used.

A decorative lipstick tube that is attachable to an object, especially to an exposed wearable object such as a fashionable necklace, and that conforms to the rapid connect/disconnect paradigm, would have several advantages: the user could visibly display the ornate design of tube and pendant to which it may be connected, the vicinity of the lipstick at the necklace would assure instant availability for the user, and the elegance of the necklace would be undisturbed after disconnection of the tube from the necklace or necklace pendant. Alternatively, the emphasis on elegance could be shifted primarily to the necklace pendant with the purpose to hide the attached lipstick tube that may perhaps show signs of wear, or be a bargain brand, or be otherwise visually unimposing, while maintaining ready availability of the lipstick.

Modern lipstick tubes, as exemplified in FIG. 1, bear the hallmarks of elegance but, regrettably, they are devoid of attachment options to a wearable object, such as a necklace, to create displays that are safe, practical and elegant. This predicament extends to the most recent trend toward high-end cap-less tubes whose rise in popularity is surely inspired not only by the modern tube architecture but also by the love for times past, as evident in the revival of Guerlain Rouge Automatique in a gold case with push-up mechanism with its origin in 1936.

The following patents illustrate the trend toward these tube designs:

U.S. Pat. No. 8,152,398 and WO2011002265: One-hand lipstick container,

US 20100054842: Slide up lipstick dispenser, and

U.S. Pat. No. 8,267,606: Device for packaging and dispensing a stick of product especially a cosmetic product.

In spite of these new developments, the lack of attachment options to a wearable object, especially to a necklace, to create an integrated decorative display, also prevails in this category of tubes. Many of today's popular tubes resemble works of art but, sadly, they are usually hidden from view. There is a real need to endorse lipstick tubes with the esteem of elegance and practicality, to render the combination of lipstick tube and necklace a pleasing décor, to equate cosmetic lipstick tubes with displayable jewelry and to provide means to achieve practical and graceful connectivity options between tube and necklace.

There were attempts made to make lipstick tubes connectable to an object, such as a wearable item, as evident from the patents listed below:

U.S. Pat. No. 2,079,043: Jewelry setting perfume holder,

U.S. Pat. No. 4,023,712: Portable spray container device,

U.S. Pat. No. 4,964,570: Perfume dispenser, and

U.S. Pat. No. 6,425,506: Decorative cosmetic case.

These patents describe decorative containers for cosmetics that could conceivably be worn as appendages to necklaces, but the described products are cumbersome to use and suffer from the disadvantages of bulkiness, substantial additional weight, lack of user-friendliness, and elegance.

With the increased tendency of users toward costly and jewel-like lipstick tubes, the prospect of tube refillability gains in significance. Efforts directed toward economy in the lipstick sector date back a long time and are manifest in the concept of refillable tubes. Already in 1950 there was the "Interchange Lipstick" and illustrated by an advertisement by Gala of London: "Every refill is encapsulated in its own gold-coated shell." The following patents serve as examples for these activities:

U.S. Pat. No. 2,497,950: Changeable and refillable lipstick assembly,

U.S. Pat. No. 2,629,489: Refill cartridge,

U.S. Pat. No. 2,678,128: Refill cartridge for lipstick holders,

U.S. Pat. No. 2,753,991: Lipstick refill cartridge,

U.S. Pat. No. 2,767,834: Lipstick refill cartridge,

U.S. Pat. No. 2,921,675: Refillable Lipstick container,

U.S. Pat. No. 3,230,960: Lipstick holder having a drive carriage with detachable cosmetic cup, U.S. Pat. No. 6,923,589: Lipstick case and refill cartridge, and EP 0597591: Cosmetic applier comprising a container assembly and an insertable pomade cup assembly.

Of these, U.S. Pat. No. 2,497,950 describes a lipstick container, together with several pomade-filled cups, arranged in a container. The cups can be pushed into a holder in the lipstick container for use and then later be pulled out so that other colored pomades may be substituted.

U.S. Pat. No. 2,629,489 provides a refill cartridge wherein a circumferential band grips the transparent housing and cup.

U.S. Pat. No. 2,678,128 provide a cup containing the pomade, a transparent housing which fits over the cup and pomade, and a cap which fits over the assembly over the bottom. For use, the cap is removed and the cup is inserted into the cup holder of the lipstick container. The transparent housing is then pulled away, exposing the lipstick.

U.S. Pat. Nos. 2,753,991 and 2,767,834 show similar arrangements where the pomade cup is pressed into a holder in the lipstick container.

U.S. Pat. No. 2,921,675 describes a lipstick container in which lipstick is removably insertable at the open end thereof, and wherein the lipstick is part of a lipstick-cartridge assembly, sealed by a removable and disposable closure cap, the seal being broken and the cap being removable upon placing of the cartridge to the open end of the container.

U.S. Pat. No. 3,230,960 describes a lipstick holder having a drive carriage with detachable cup in connection with a screw mechanism for the advancement or retraction of the lipstick containing cup. This cup is connected via a ball and socket joint to the carriage that engages with the internal screw-thread. To replace the lipstick, the carriage has to be extended upward and the ball and socket connection between cup and driving-carriage has to be broken by pulling. A plastic cover frictionally engages with the replacement pomade and cup. Refilling of the holder proceeds by reversing these steps; the new pomade cup is connected, the holder retracted and the pomade withdrawn from the plastic cover.

U.S. Pat. No. 6,923,589 describes a lipstick case with refill cartridge but the so-called "refilling cartridge" consists of the entire tube assembly including the cup containing the pomade, the tubular inner sleeves and the end cap. This entire unit is contained in a lipstick case that consists of three interlocking units. The resulting assembly has gained in width and weight and after depletion of the lipstick material there is no protocol for replacement of the "refilling cartridge" so that the user has to replace the entire tube assembly.

EP 0597591 is a variation of similar system wherein the lipstick container assembly is sold separately from the pomade cup assembly and the two assemblies are combined to make a new permanent unit at the time of purchase or thereafter.

The desire for refillable tubes continues to the present and is evident by recently published accounts that describe how to clean a used tube, how to melt lipstick remnants, how to cast a new lipstick from the molten mass, and how to insert the cast lipstick into the tube.

With the goal of economy, simplicity, expeditiousness, and a drive toward green solutions, some aspects of the many proposals described in the above cited patents for the lipstick exchange operation are, in principal, applicable to the subject matter at hand. The adoption of this technology to the modern tube architecture, together with the need to streamline the lipstick exchange process, however, requires additional modifications of the interior sleeves and of the exchange cartridge.

In the course of the lipstick exchange, the cartridge is inserted into the sleeve assembly followed by advancing the cup into the tube interior with concomitant removal of the protective cap from the cup. During this operation the rotator is turned which causes breakage of the seal between the protective cap and the cup which holds the pomade, followed by lifting the protective cap from the cup in a longitudinal direction. This action is achieved by the impulse exerted by the lugs 03 on the vertical slots in the inner sleeve and further by the interaction of the lugs with the helical grooves. While this procedure is functional in the sturdy tube constructs of yesteryear, today's tubes are light-weight and the three elements mentioned above are frangible. To adapt these elements to the lipstick exchange option, and to protect them from damage by the force generated by the rotator, it is essential that this force is minimized by rendering the removal of the protective cap from the cup as easy as possible. What is needed, therefore, are protective covers of the pomade that combine adequate protection with ease of removal from the cup during the exchange operation.

As mentioned above, the sleeves of modern tubes with swivel mechanism, geared toward lipstick advancement and retraction, are light-weight and thin-walled and are circumferentially embraced by a protective and ornate outer sleeve that is not transparent thus concealing the inner sleeves. For the lipstick exchange operations, however, the alignment of the slots in the most inner sleeve with the helical groove endings located at the central sleeve, is required but not readily achievable as the decorative outer sleeve completely hides slots and grooves in the sleeve assembly. Even when viewed from the top, and in absence of the cup that holds the pomade, this alignment is not facile, especially since most sleeves are now usually constructed of black plastic material with contours that are difficult to see. What is needed is a sleeve assembly that permits the visualization of the required sleeve alignment of the slots at the inner sleeve with the helical grooves at the central sleeve in a side view, and wherein such an alignment is visually unobstructed by the presence of any decorative outer sleeve.

SUMMARY OF THE EMBODIMENT

Figure 1A:
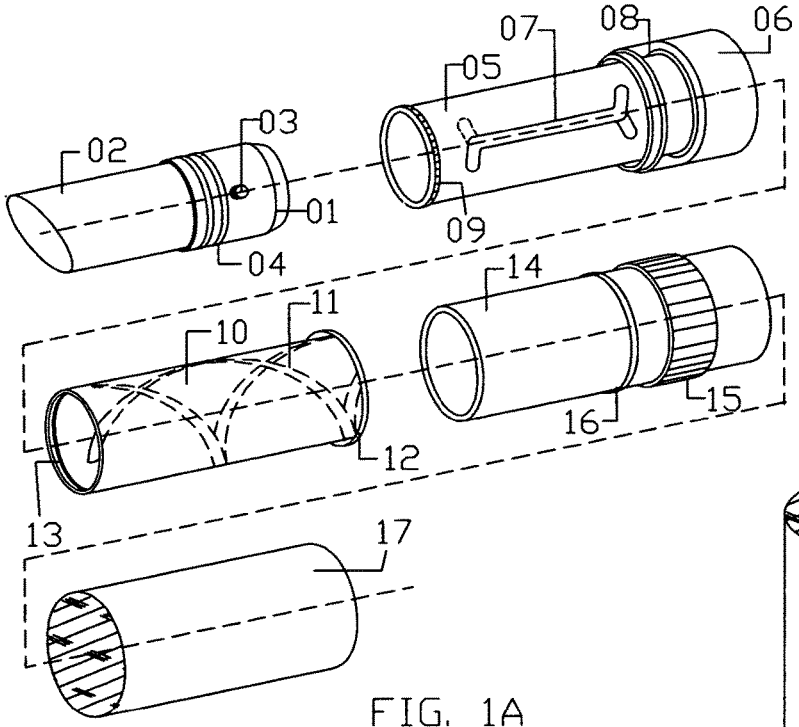
FIG. 1A shows the components of the contemporary lipstick tube.
Figure 1:
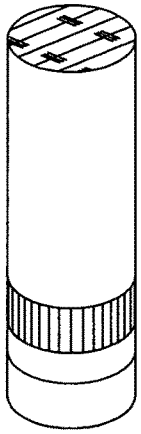
FIG. 1 (PRIOR ART)
FIG. 1 shows a contemporary lipstick tube.

It is object of the embodiment to provide a cosmetic container, especially a lip balm tube, with a connectivity option to a wearable object, such as a necklace, wherein the shape of the rotator is transitioned from a cylindrical to a flat ending and wherein said ending is perforated and wherein the resulting opening can be used to connect to a clasp or to the strands of a necklace.

Another object of the embodiment is to provide a lipstick tube, wherein the rotator is solidly integrated with one end of a quick-release buckle, and wherein the other end is connectable to a necklace.

Another object of the embodiment is to provide a lipstick tube wherein the tube contains radially protruding pegs which function as attachment means to the strands of a necklace. Alternatively, the pegs can engage with a coupling, such as a horse-shoe-shaped bracket whose termini contain openings and where the coupling is manufactured of a material of sufficient resilience and stretchability so that it can be fitter over the endings of the tube and wherein the openings of the coupling can be inserted into the pegs, and wherein the distance between coupling and tube is sufficient to accommodate the strings of a necklace.

Another object of the embodiment is to provide a lipstick tube wherein either end of the tube contains a groove cut of trapezoidal cross section and in a direction perpendicular to the longitudinal axis of the tube. This groove cut accepts a coupling with a matching trapezoidal profile wherein optional detent elements in groove and coupling can further stabilize the tube-coupling interphase and wherein the coupling can function as a connectivity element to a necklace.

Another object of the embodiment is to provide a lipstick tube suitable for attachment to a necklace wherein the coupling to the necklace is realized in the form of an appendage with mutually opposing extensions at the end and wherein this appendage overarches the tube terminus and be held in place by engagement of the above-mentioned mutually opposing bracket extensions with diametrically positioned apertures in the tube body. The shape of this appendage can be manifold; it can take the form of a simple bracket constructed of resilient and springy material, or it may comprise sturdy bracket extensions insertable into the tube apertures either by a springy interphase or a lockable hinge system.

Alternatively, the tube receives an aperture in the form of a bore, applied in the direction of the longitudinal axis, where the inside of said aperture contains detent means so that a plug can be pushed into the aperture and be held in position by detent means, and wherein the plug may be equipped with matching detent elements, and wherein the plug provides an eyelet for further connectivity to a necklace or a coupling, or wherein the tube terminus receives a pair of such bores located centrally and parallel to the longitudinal axis to accommodate a pair of plugs, connected with each other and held in place by friction fit or by mutual detent means at the plugs and the bores, and wherein the connection element between the pugs provides the opening for further connectivity to a necklace or a coupling.

Another object of the embodiment is to provide a decorative appendage for a necklace that can connectively engage a lipstick tube to create an attractive display and wherein this appendage engages with a matching décor at the tube and wherein the connectivity between pendant and necklace is based on typical clasp connectivity elements such as hook and loop.

Another object of the embodiment is to utilize a necklace with a clasp consisting of two halves, held together by magnetic implants in each, and wherein the clasp permits the intercalating of a lipstick tube which is equipped with magnetic implants at both tube termini so that the implants at the tube interact with the corresponding magnets at the clasp and the tube can be worn horizontally.

Another object of the embodiment is to provide a decorative décor such as a pendant for a necklace that can connect to a lipstick tube wherein the connectivity between pendant and tube is based on the interaction of two matching layers of grip tape.

Another object of the embodiment is to provide a coupling that mediates connectivity between lipstick tube and wearable object, such as a necklace, and wherein the coupling connects to the tube using friction fit via O-ring and wherein connectivity to the necklace is further provided by eyelets or by other means such as hook and loop.

Another object of the embodiment is to provide a coupling that mediates connectivity between lipstick tube and wearable object, such as a necklace, wherein the coupling consists of a platform from which several springy claws emanate downward and wherein those claws provide a cage that is restricted in the center but wider at the bottom to form an opening so that a lipstick tube can be inserted into that opening and be held in place by friction fit due to the restriction and resiliency of the claws in the center, and wherein the platform provides connectivity options to a necklace such as suitably dimensioned eyelets or other clasp elements.

In yet another aspect the embodiment relates to an adapter that mediates connectivity between a lipstick tube and a necklace appendage, wherein the connection between adapter and tube is accomplished via layers of matching grip tapes and connectivity between adapter and necklace appendage is based either on magnetic interaction or other clasp elements.

In yet another aspect the embodiment relates to an attachment option of a lipstick to a wearable object, such as a necklace, consisting of a hollow tube, open on the bottom and whose side walls are partially resected to generate an open section at the back and wherein this tubular section is covered at the top to form a shallow cup with connectivity means to a necklace and wherein the interior of the aforementioned cup is clad by a grip tape layer so that a cosmetic container, such as a lipstick tube, that is equipped with a grip tape layer at the terminus, can be inserted into the cup and held in place by the resulting grip tape layer interphase.

Another object of the embodiment relates to a decorative pendant on a wearable object, such as a necklace, wherein the backside of the pendant is pivotably connected to a shallow cup that is clad at the inside with grip tape and, upon extension at an angle of 90 degrees with respect to the pendant, can accept and hold in position a lipstick tube, equipped with a grip tape layer at one of its termini, so that an arrangement results wherein said appendage partially obscures the lipstick tube from front view.

Another object of the embodiment is to utilize a necklace with a clasp consisting of two halves, held together by layers of grip tape in each, and wherein said clasp permits the intercalating of a lipstick tube which is equipped with complementary layers of grip tape at both termini so that the tube can be worn horizontally and wherein further modifications of the clasp design lead to different degrees of obscurements of the grip tape interphases between tube and clasp.

Another object of the embodiment relates to a decorative, flat appendage to a wearable object, such as a necklace, whose top has a groove that is slidably connected to a corresponding tongue section at a necklace and wherein the backside of the appendage is clad, in part, by a grip tape layer to enable said appendage to mediate the wearing of any small object, such as a lipstick, a key, a flash drive, a watch, or a small electronic device, provided that one side of said object can be equipped with a suitable section of a grip tape. Among the lipstick tubes, those with prismatic shape are particularly suitable as they present a flat side to accept a relatively larger grip tape layer area for engagement with the grip tape at said appendage.

In yet another aspect, the embodiment relates to lipstick tubes where the pomade is refillable or replaceable. This technology dates back some 60 years and is described in numerous patents, especially in U.S. Pat. No. 2,921,675, but significant improvements are subject to the embodiment. The lipstick exchange operation utilizes cartridges, each comprising the lipstick pomade in a cup and protected by a temporary cap or cover, made of a translucent polymeric material that extends over the periphery of said cover and functions as a protector of the pomade and as a seal for purity. The embodiment relates to these cartridges and further to the required sleeve modifications that are part of the lipstick tube and are responsible for lipstick transport within the tube. Toward this goal, the protective cap removal from the cartridge is facilitated by peripheral resections of the cover or, alternatively, by flaring the lower end of the cover with a number of vertical incisions. The refilling operation requires modification of the interior sleeves that are part of the lipstick advancement mechanism to allow insertion and removal of the cup holding the lipstick. In an amendment to the existing technology, the embodiment relates to sleeve modification that enable slot and groove alignment in a lateral view. These sleeve orientations are required for the exchange operation but rapid attainment of these orientations is achieved by cutouts in the sleeves to allow lateral recognition of congruency between the commencements of the helical grooves with the vertical slots.

Further aspects, details, and advantages will become evident from the drawings and the descriptions therein.

DETAILED DESCRIPTION OF THE EMBODIMENT

In the above and subsequent description of the present specifications, suitable examples of the definitions to be included within the scope of the invention are explained in detail below.

The term "cap" refers to the protective lipstick tube cover, which is the protective shield for the pomade.

The term "cartridge" refers to the unit comprising cup, lipstick pomade, and protective cap or cover wherein the cup is the receptacle for the pomade.

The term "clasp" traditionally refers to the device that is used to connect the strands of a necklace; the variety of claps is almost limitless as exemplified by barrel clasps, snap clasps, hook and eye clasps, spring ring clasps, lobster claw clasps, toggle clasps, coil clasps, friction clasps, S-clasps, safety clasps, magnetic clasps, neckstraps, jump rings, swivel clasps, box clasps, and split rings. Certain clasps are occasionally used in conjunction with safety straps or chains. A clasp can also mediate connectivity between a lipstick tube and a necklace or between tube and pendant.

The term "coupling" refers generally to the device that mediates the connection between lipstick tube and the attachment object, such as a brooch or a necklace, and includes necklace pendants and appendages.

The term "grip-tape" as used herein refers to a component pair wherein the surface of one component can engage with the surface of the other by pressing them together and cause physical adhesion of the two components, and wherein each component can be attached to a solid surface, preferably by glue joint. Grip tapes fall basically into two categories. The first category is the "hook-and-loop fastener" which refers to a component pair wherein the surface of one component features tiny hooks; the second features even smaller loops; upon pressing the components together the hooks catch the loops and the two pieces bind temporarily until being pulled apart. The second category is the "power-grip" fastener where the surfaces of the component pair involved in the physical adhesion are virtually identical. In one example, the surface consists of tiny mushroom-shaped posts so that the component pair can mate to itself. The commercially available tape is typically a polyester fabric re-enforced double-sided tape with a powerful synthetic rubber/resin adhesive designed for bonding almost any material. In general, the grip tape is glued to the object by pressure-sensitive or solvent activated backings and is applied according to the manufacturer's recommendation. Although a large variety of grip tapes exist, the adhesion properties and physical characteristics, especially between the partners of the matching pair, is appreciated and recognition of these differences is implied and henceforth not further elaborated in the proceedings.

The term "groove cut" as used herein refers to a cut into a material and when viewed in cross-section, the cut is three-sided so that the ends of the surface into which it is cut are undisturbed by said cut.

The term "intercalation" as used herein refers to the positioning of a lipstick tube between the strands of a necklace wherein both termini of the tube engage with the strands of the necklace either directly or with the intermediacy of a clasp.

The term "lipstick," as defined in Webster's New Twentieth Century Dictionary 2$^{nd}$ Edition, is "a rouge compressed into a stick form, used to color the lips, or a similar stick of colorless pomade for softening and protecting the lips." According to general usage, however, "lipstick" is not only synonymous with pomade, lipstick material, or lipstick mass, but embraces all cosmetics for the lips including lip balm and liquid lip coloring agents or liquid lip treatment means.

The term "lipstick tube" refers to the primary packaging and encompasses the entire protective assembly for the lipstick, including the outer shell, holder and advancement mechanism for the pomade including swivel and push-up types, and any protective closure such as a cap or a hinged door. The term is synonymous with lipstick case or lipstick container and includes containers that house related products for topical applications such as lip gloss, eye shadow pencils, mascara, or similar items.

The term "lipstick tube terminus" refers to the area that describes the end of a tube; most often this area is perpendicular to the longitudinal axis of the tube.

The term "push-up mechanism" refers to the means that cause axial displacement of a cup containing lipstick, where the cosmetic container housing said cup typically has an outer shell, said cup containing the pomade residing within, and axially displaceable by moving a lever, connected to said cup and protruding to the outside of said cosmetic container, along a narrow slit.

The term "rabbet cut" as used herein refers to a recess or cut into the edge of a material and when viewed in cross-section, the cut is two-sided and open to the edge or end of the surface into which it is cut.

The term "rotator" refers to the rotatably mounted portion of the tube body wherein said portion of the tube body is connected to a sleeve that mediates lipstick advancement or retraction by further integration with internal tube elements as common in the swivel-type tubes, or wherein said portion of the tube body mediates lipstick advancement via an internal screw assembly.

The term "swivel mechanism" refers to the means that cause axial displacement of the cup containing the pomade wherein the cup resides in a cylindrical tube body with an interior sleeve equipped with two vertical slits, inside which said cup moves due to two protrusions, lugs, or pins which pass through said slits of said interior sleeve and further into two complimentary helical grooves of a central sleeve, such that relative rotatory movement between said central sleeve and said inner sleeve causes axial displacement of cup and pomade.

The term "tube" as used herein includes all types and shapes of tubes, primarily those that house the material for lipstick cosmetic and may be of variegated shape such as cylindrical, near cylindrical, or prismatic, including tubes with oval cross-sections and the like, with or without the protective cap; the cross section of the lipstick material may thus be circular, oval, rectangular, and the like; the term "tube section", may imply any part of the tube body, including the rotator and the protective cap.

The embodiment will now be described in detail with reference to the accompanying drawings in which preferred embodiments of the invention are shown.

Figure 2:
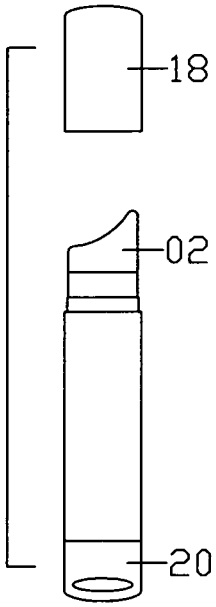
FIG. 2 is a plan view of a lipstick tube with attachment options to a wearable object such as a necklace using a tapered and perforated rotator.
Figure 2A:
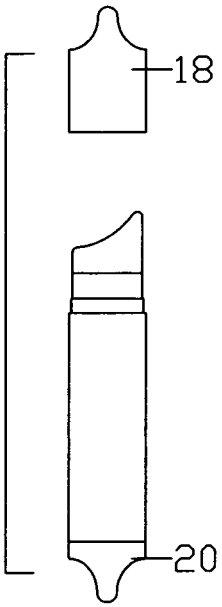
FIG. 2A is a side view of FIG. 2.

Referring to FIG. 2 of the drawings, a preferred embodiment of the lipstick tube comprises an attachment option to an object, such as a necklace, at the perforated rotator 20. These tubes are simple in design with emphasis on practicality and are particularly suitable for lip balm. The tube endings 18 and 20 are transitioned from the conventional cylindrical to flat, nearly prismatic endings, as seen in the side view in FIG. 2A. These transitions lead to a more compact appearance, especially after a string or necklace has been inserted through the perforation, and function like twist knobs whose larger surface facilitate both manual turning of the rotator 20 and removal of the cap 18 which can also transitioned to a nearly prismatic ending. For outdoor use, the necklace materials are typically smooth and flexible such as leather, fabric, rubber, or plastic lacing.

Figure 3:
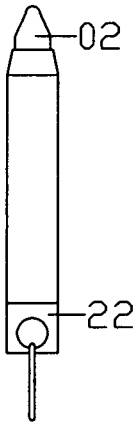
FIG. 3 is a plan view of a "slimtube" with an attachment option to an object, such as a necklace or a key chain, originating at a tapered rotator.
Figure 3A:
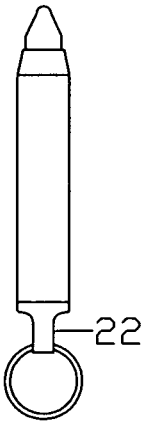
FIG. 3A is a side view of FIG. 3.

FIG. 3 shows a plan view of the recently popularized "slim-tube" with such a modified rotator 22 to benefit from the above mentioned advantages. The prismatic ending is illustrated in a side view in FIG. 3A and shows the use of the perforated rotator 22 for connectivity to an object in the form of a ring that can serve as a coupling to a necklace.

Figure 4:
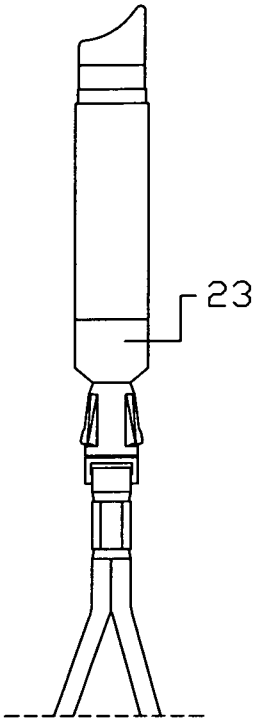
FIG. 4 is a plan view of a lipstick tube modified at the rotator with a rapid connect/disconnect interface in the form of a built-in neckstrap.

The embodiment also refers to FIG. 4 as an example of a tube with rapid connect/disconnect ability to and from a necklace wherein a side-release buckle in the form of a neckstrap is integrated with the rotator. In this example, the lipstick tube extends to the rotator 23 that is solidly connected with one part of the buckle while the other part serves as a coupling to a necklace.

Figure 5:
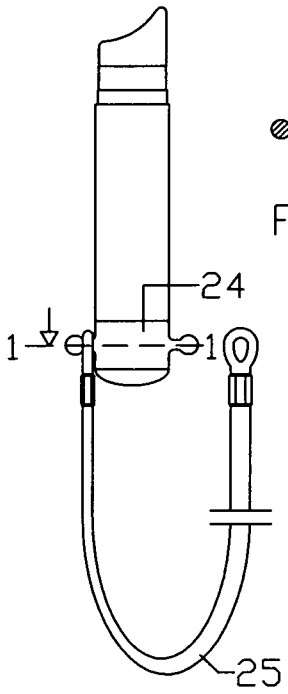
FIG. 5 is a plan view of a lipstick tube equipped with diametrically exposed lugs that can accommodate the loops of a necklace.
Figure 5A:
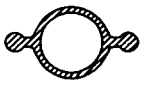
FIG. 5A is a cross section view of the rotator shown in FIG. 5.
Figure 5B:
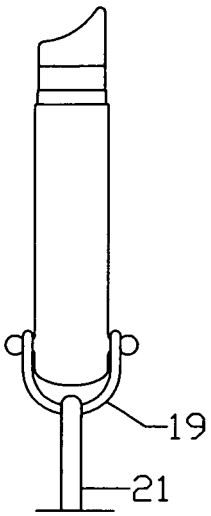
FIG. 5B is a plan view of a lipstick tube shown in FIG. 5 wherein accommodation with the necklace is achieved with the intermediacy of a coupling.
Figure 5C:
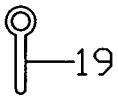
FIG. 5C is a side view of the coupling shown in FIG. 5B.

The embodiment also refers to FIG. 5 where the rotator 24 of the tube is modified to afford intercalation into a necklace 25 via two laterally and diametrically exposed lugs or pegs as seen in the cross-section along the plane 1-1 and illustrated in FIG. 5A. The necklace may remain in place after removal of the tube by squeezing the loop of one ending and pushing it through the loop of the other. Alternatively, the pegs can be connected to a coupling, such as a horse-shoe-shaped coupling 19 as seen in FIG. 5B whose termini are in the form of openings or eyelets shown in a side view in FIG. 5C. The coupling fits over the endings of the tube and the openings in 19 are pushed into the pegs. The resulting distance between coupling and tube is sufficient to accommodate the strings of a necklace 21 which is now completely independent of the tube construction. The material used for the manufacture of the coupling should be of sufficient resilience and stretchability to permit ready engagement with the pegs.

Figure 6A:
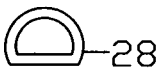
FIG. 6A is a plan view of the D-ring in FIG. 6.
Figure 6C:
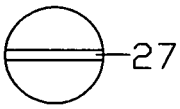
FIG. 6C shows a top view the lipstick in FIG. 6 with emphasis on the groove.
Figure 6E:
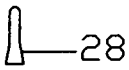
FIG. 6E is a side view of the D-ring with emphasis on the trapezoidal portion designed for engagement with the groove shown in FIG. 6B.
Figure 6:
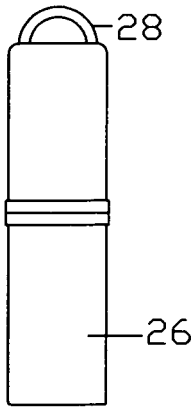
FIG. 6 is a plan view of a lipstick tube with a connectivity option to a necklace mediated by a D-ring.
Figure 6B:
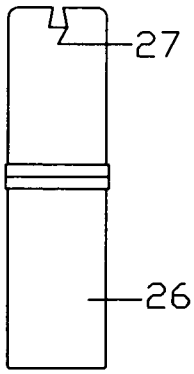
FIG. 6B shows the horizontal groove in the lipstick tube with a trapezoidal cross section for acceptance of the D-ring.
Figure 6D:
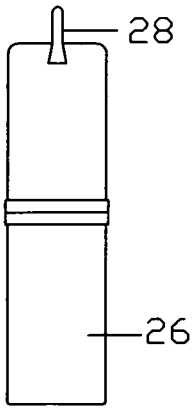
FIG. 6D is a side view of FIG. 6.

The embodiment also refers to FIG. 6 which illustrates a lipstick tube 26 with a coupling 28 as detailed in FIG. 6A. The attachment of coupling 28 to tube 26 is based on a tongue and groove interphase wherein the groove 27 is provided by tube 26, as seen in a plan view FIG. 6B, and in a view from the top in FIG. 6C. The tongue is derived from the coupling 28, exemplified in the form of a D-ring, with a side view shown in FIG. 6E and in FIG. 6D after engagement with tube 26. Groove 27 and coupling 28 can optionally be equipped with complimentary detent features, such as a ball detent (not shown). The coupling 28 can provide connectivity to a necklace either directly or through the intermediacy of a clasp.

Figure 7:
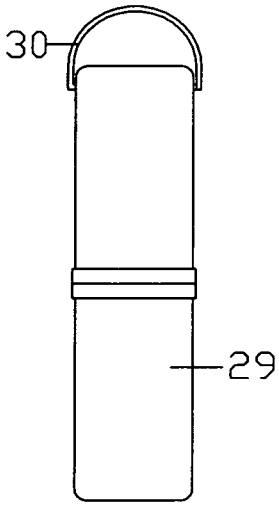
FIG. 7 is a plan view of a lipstick tube with lateral connectivity to a coupling that can serve as attachment means to a necklace.
Figure 7A:
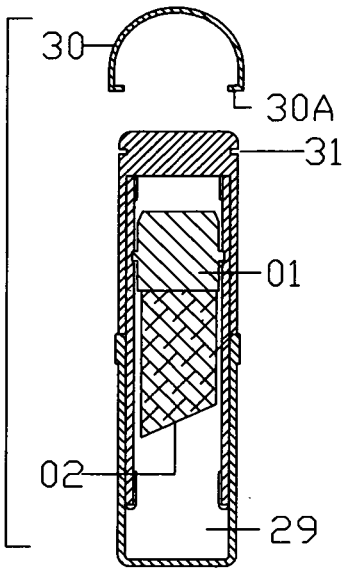
FIG. 7A is a vertical section view of FIG. 7 wherein the coupling is disengaged from the tube.

In a further example, the embodiment relates to FIG. 7 which shows a plan view of lipstick tube 29 equipped with a coupling, exemplified by 30, that can directly connect to a necklace. FIG. 7A is a vertical section view of tube 29 and details two diametrically opposed cylindrical openings, holes, or apertures 31, designed to pivotably engage with coupling 30, or with other couplings as exemplified in FIGS. 7E to 7G. Optionally, the apertures 31 are lined with metallic inserts or grommets (not shown). FIG. 7A also conveys schematically the inner sleeves in tube 29 and the position of lipstick cup 01 and pomade 02, but coupling 30 has been disengaged from tube 29 to enhance the visibility of the apertures 31 at the tube and the matching coupling extensions 30A designed for insertion into the apertures 31.

Couplings of the type 30 are constructed of materials with sufficient flexibility and spring action to engage into and, if so desired, disengage from the apertures 31 via the two opposing coupling extensions 30A facing each other. The coupling extensions 30A are fabricated with circular cross sections to assure free rotation within the apertures. Thus, the couplings can readily rotate into a position on either side of the tube. The dimensions of the extensions 30A are adjusted to the depths of the apertures which are dictated by the type of materials used for the manufacture of the lipstick tube.

Figure 7B:
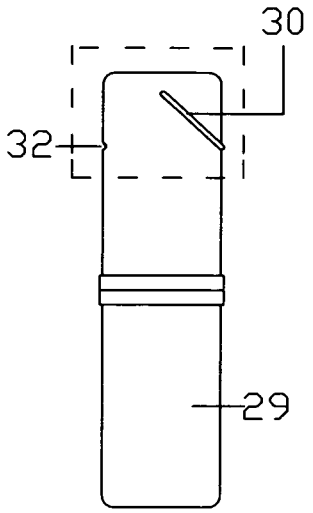
FIG. 7B shows the lipstick tube of FIG. 7 to emphasize the partial accommodation of the coupling by the tube body.
Figure 7C:
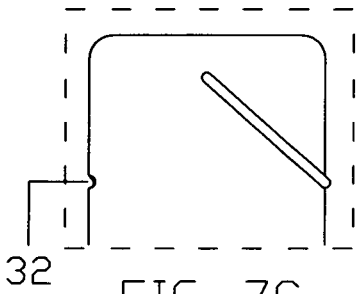
FIG. 7C is an enlargement of the upper portion of FIG. 7B.
Figure 7D:
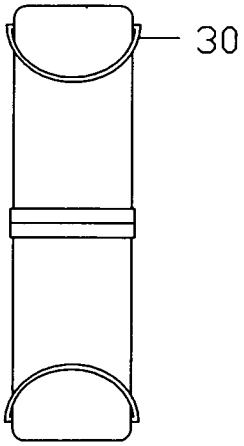
FIG. 7D is a plan view of a lipstick tube wherein the lateral connectivity to a coupling is repeated at the opposite tube terminus to illustrate the compactness of the design and the opportunity of wearing the lipstick tube horizontally on a necklace.

With the intent to leave the couplings 30 in place after removal of the tube from the necklace and to render the tube more compact, the outer tube body is optionally provided with two diametrically opposed indentations 32 shown in a plan view in FIG. 7B, and in an enlarged partial view in FIG. 7C. A duplication of the apertures 31 and the indentations 32 at the opposite part of the tube, and insertion of an additional coupling 30, results in a construction depicted in FIG. 7D. This compact design permits the tube to be worn horizontally on a necklace after proper positioning of the couplings 30.

Figure 7E:
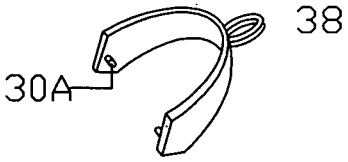
FIG. 7E is a=perspective view of a coupling of different design.
Figure 7J:
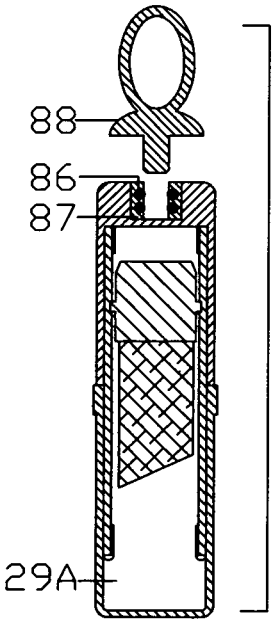
FIG. 7J is a section views of a lipstick tube and a necklace appendage wherein tube and appendage are connectable by friction fit via O-rings.
Figure 7F:
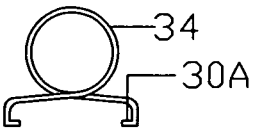
FIG. 7F is an example of a coupling that is removable from the tube by squeezing the coupling element diametrically.
Figure 7G:
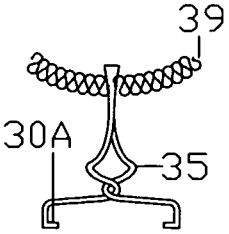
FIG. 7G shows a variation of FIG. 7F wherein the attachment to a necklace is indicated.
Figure 7H:
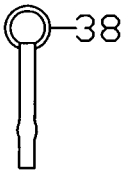
FIG. 7H is a side view of the coupling shown in FIG. 7G.

Depending on the desired effect, different couplings can be employed to either enhance elegant appearances, as exemplified by a version with an unobtrusive eyelet 38 as shown in FIG. 7E, or to emphasize ease of attachment and removal to and from a necklace using the example couplings shown in FIGS. 7F and 7G. Once installed, squeezing of the loops or bulges 34 and 35 causes slight deformations and concurrent relaxation of the pinzer effect exerted on the tube by the extensions 30A. As a result of this relaxation, the distance between the opposing extensions 30A is increased and the tube can be removed from the coupling without disturbing its presence at the necklace. The coupling in FIG. 7F has a built-in loop 34 while the coupling in FIG. 7G contains a circular eyelet 38 at the top as shown in a side view in FIG. 7H to accommodate a decorative chain such as necklace 39. For occasions when the presence of a lipstick at the necklace is not desired, a properly prepared decoration, such as a mounted semiprecious stone with lateral apertures 31 for example, can temporarily replace the lipstick tube at any coupling exemplified above.

Figure 7K:
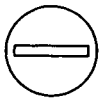
FIG. 7K is a top view of the appendage shown in FIG. 7J.

A further variation of the coupling system presented above is shown in FIG. 7J. A central bore in tube 29A, in the direction of the longitudinal axis, is occupied by an insert 87 with a central and cylindrical opening extending in the longitudinal direction and designed to accept a coupling in the form of a plug 88. This plug consists of a cylindrical socket at the lower end that can be pushed into the central opening of the insert 87 and be held in place by friction fit, as exemplified by two O-rings 86 positioned parametrically within the grooves in the insert 87. This socket that is part of plug 88 extends upwards to the bottom of a spherical segment, designed to cover the tube perimeter upon plug insertion, and wherein the upper part of the spherical segment transitions to a ring-like loop or eyelet for connectivity to a necklace. A view of coupling 88 from the top is seen in FIG. 7K to illustrate the upper part of the loop. The transition of the plug and spherical segment in 88 to a different clasp element, extends to utility as exemplified by a laterally positioned bar pin that permits the assembly to be worn as a brooch (not shown).

Alternatively, the lipstick tube terminus receives two bores centrally applied in the direction of the longitudinal axis of tube 29A and designed to be occupied by a pair of plugs (not shown). The upper ends of the those plugs are connectively integrated to form a loop that can serve as an eyelet for a necklace or for a coupling, and the lower part of the plugs are designed for insertion into the apertures wherein both apertures and plugs receive, optionally, matching detent elements (not shown).

The rotator is typically a solid or thick-wall material that is the preferred site of the apertures 31 and numerous materials with spring action are available for the construction of the many choices of couplings. The preferred materials range from polymeric materials to metals and alloys including high-carbon spring steel, alloy steels, stainless steels and non-ferrous metals and alloys. Some of these materials can be electroplated to achieve desired colors and finishes. Alternatively, they may be toned in various ways to match lipstick tube and necklace, appendages, or pendants to which they are attached. In view of the simplicity of the couplings, combined with the ready snap-on feature, a lipstick tube for sale can be provided with couplings of different colors and metal tones, together with one or more decorative lipstick substitutes. The visual appearances of the disconnected tubes are not compromised by the unobtrusive apertures 31 or by the inserts 87 which can, optionally, be filled with plugs that function as decorative tube ending thereby enhancing the appearance of the lipstick.

Figure 8:
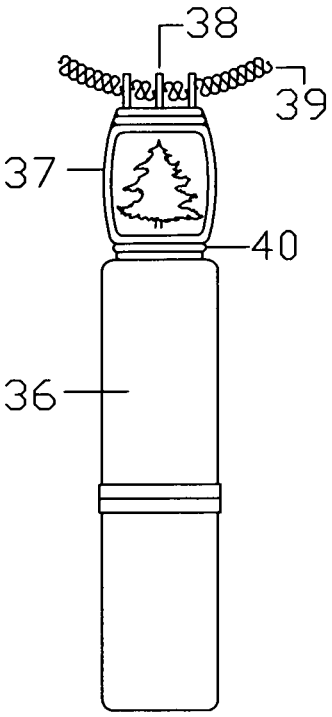
FIG. 8 is a plan view of a flat and decorative necklace pendant connected to a necklace at the top and to a lipstick tube at the bottom.
Figure 8A:
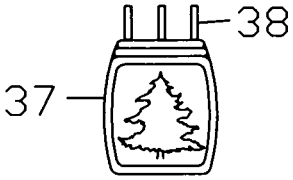
FIG. 8A is a plan view of the pendant shown in FIG. 8.
Figure 8B:
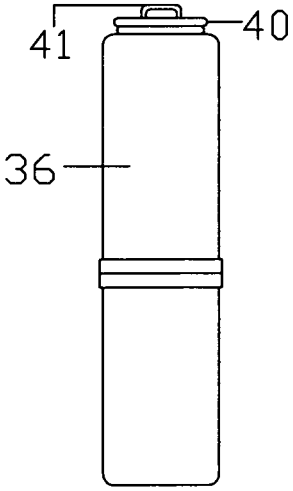
FIG. 8B is a plan view of the lipstick tube of FIG. 8, together with the lower portion of the decorative pendant that carries a loop at the top.
Figure 8D:
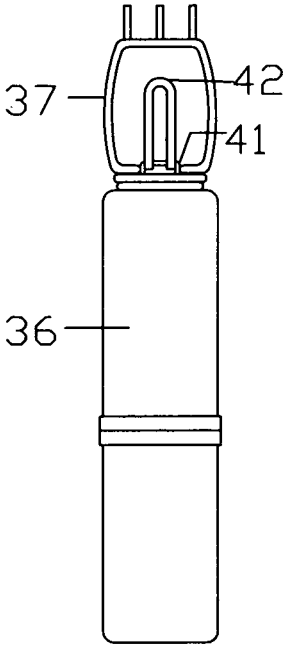
FIG. 8D is a rear view of FIG. 8 to expose the hook in the form of a U-shaped bar that connects with the loop at the tube.
Figure 8C:
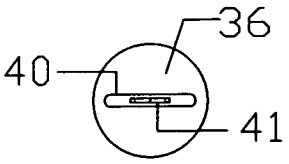
FIG. 8C is a top view of the lipstick tube in FIG. 8B to further illustrate the lower portion of the decoration and the loop in the center.
Figure 8E:
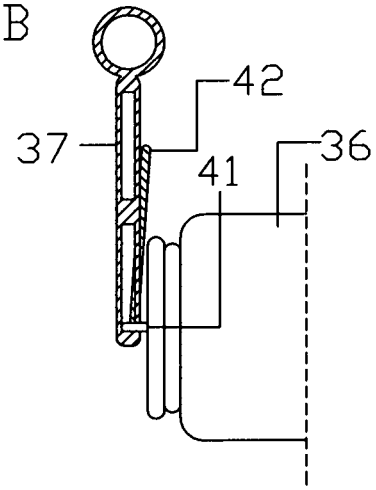
FIG. 8E shows an enlarged section view the pendant seen in FIG. 8A as viewed from the side, together with an overlay of the upper portion of the tube in a plan view, to illustrate engagement of the loop at the tube and the hook at the appendage.

Another embodiment relates to a decorative pendant that can couple to a lipstick tube by simple mechanical means as illustrated in FIG. 8 which shows a tube 36 attached to a flat pendant 37 that is linked to a necklace 39 via three eyelets 38. Upon disconnection of the tube, part of the pendant décor 40 resides at the tube as seen in FIGS. 8A and 8B. On top of the tube is a small bracket in the form of a U-shaped loop 41, preferably manufactured of a material with circular cross section and attached rigidly to 40 which is rigidly connected to the tube body as indicated in FIG. 8B. A top view of FIG. 8B is seen in FIG. 8C which shows tube 36, the décor 40, and the loop 41. A rear view of FIG. 8 is shown in FIG. 8D which details the U-shaped bar 42 firmly attached at the lower end to the framework of the pendant 37 but with an unobstructed ending at the top to connectively engage the loop 41 located at the tube 36. An enlarged side view of pendant 37, in the form of a vertical section, is seen in FIG. 8E which depicts the bar 42 in a small acute angle with respect to the vertical axis of the framework of 37 together with the intermediary stage of attaching the tube 36 wherein the tube segment 36, together with the bracket 41, is shown in a plan view and overlaid onto the vertical section view of 37. In this image the tube 36 is held perpendicular to the vertical axis of 37, and the small angle of 42 with respect to the aforementioned axis facilitates the looping of 41 over the end of bar 42. Following this initial looping, the tube is slid down to the bottom of 42 as illustrated in FIG. 8E. Rotating the tube by 90 degrees to the vertical position restores the arrangement seen in FIG. 8. The tube is readily disconnected from the pendant by a reversal of the steps mentioned above without disturbing the decorative appeal of the pendant at the necklace.

Figure 9:
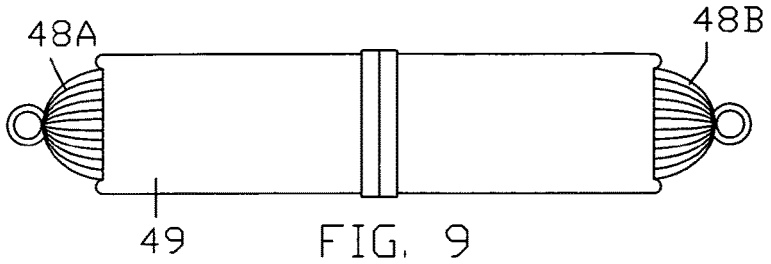
FIG. 9 is a plan view a lipstick tube with magnetic inserts at the tube termini and intercalated into a magnetic clasp with attachment options to a necklace.
Figure 9A:
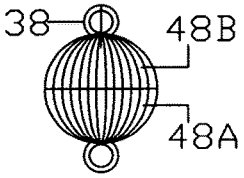
FIG. 9A is a plan view of the magnetic clasp.
Figure 9B:
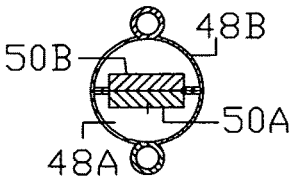
FIG. 9B is a section view of the magnetic clasp.
Figure 9C:
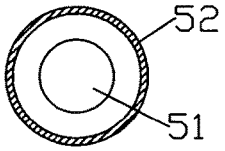
FIG. 9C is a view of the lipstick tube in the direction of the longitudinal axis.
Figure 9D:
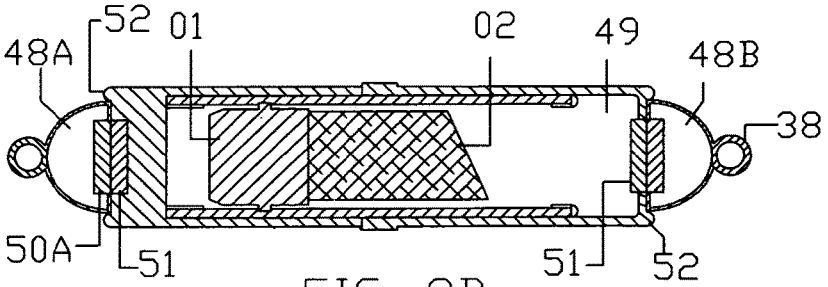
FIG. 9D is a section view of FIG. 9.

The embodiment also relates to FIG. 9 which represents a lipstick tube 49 flanked by two symmetrical halves 48A and 48B of a magnetic clasp, each half equipped with an eyelet 38 for connectivity to a necklace and shown in FIG. 9A. The two halves contain magnetic disc 50A and 50B of opposite polarity at the contact surfaces as indicated in a vertical section view in FIG. 9B. A section view of tube 49 with magnetic discs 51 at both termini is illustrated in FIG. 9D wherein the tube is intercalated into the aforementioned clasp. The side walls of tube 49 are slightly extended at the termini to form rims in the form of shallow hemi tori 52 to prevent sideways slippage of 48A and 48B. FIG. 9C is a top view of tube 49 in the direction of the longitudinal axis to illustrate the rim 52 and the position of magnetic insert 51.

Figure 10A:
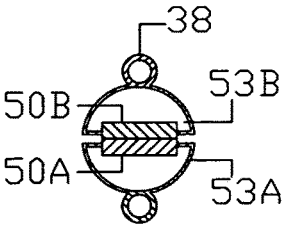
FIG. 10A is a section view of the clasp that is part of FIG. 10.
Figure 10:
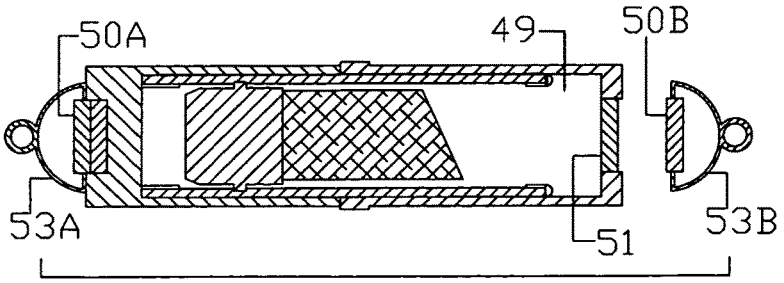
FIG. 10 is a section view of a lipstick tube flanked by the components of a magnetic clasp wherein the recessed magnets at the tube termini are in concert with correspondingly protruding magnets at the claps.

Alternatively, a clasp composed of two halves 53A and 53B with exposed and slightly protruding magnets 50A and 50B, as delineated in a vertical section view in FIG. 10A, can be employed with tubes whose magnetic elements 51 are recessed as shown in FIG. 10. In this version, the previously applied rims 52 are absent and the recessed magnets 51 engage in complete contact with the magnetic counterpart of the clasp half. To enhance the visibility of the magnetic interphase, one of the two clasp halves has been disengaged from tube 49 as seen in FIG. 10.

Regardless of the specific design variations shown in FIGS. 9 and 10, necklace and lipstick tube conform to the principles of rapid connect/disconnect; they resist loss of magnetic contact by side-way slippage and both tube and clasp retain their individual functions and attractiveness even after disengagement from each other. The magnetic inserts 51 at the peripheries of the tube termini can optionally be replaced with inexpensive unmagnetized ferromagnetic materials and, as with all horizontally worn tube designs, leashing of the eyelets of the clasps with a short and decorative chain constitutes an additional element of safety. A similar safety feature also applies to tubes where only one end is connected to a clap and consists of the addition of a small ring encompassing the tube and leashing it with the eyelet at the clasp.

Figure 11:
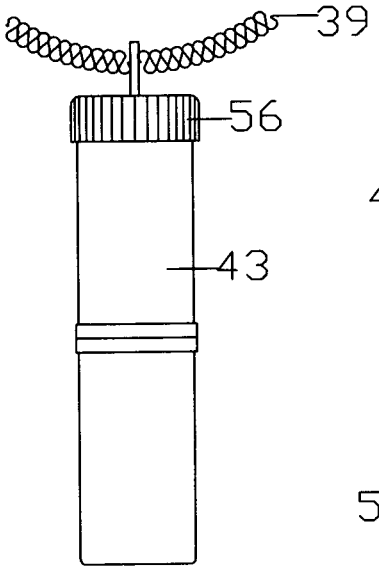
FIG. 11 is a plan view of a lipstick tube connected to a necklace with the intermediacy of a pendant.
Figure 11A:
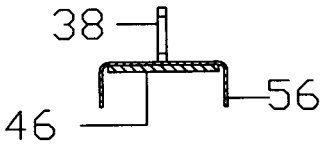
FIG. 11A is a section view of the pendant of FIG. 11 with a grip tape layer at the inside.
Figure 11B:
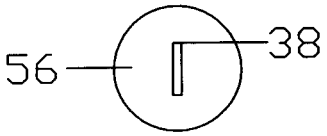
FIG. 11B is a top view of the pendant of FIG. 11A.
Figure 11C:
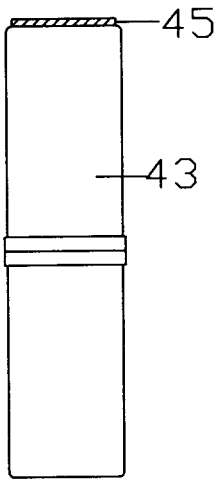
FIG. 11C is a plan view of the tube with a grip tape layer at the top.
Figure 11D:
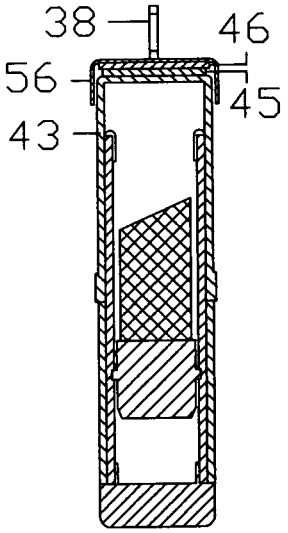
FIG. 11D is a section view of FIG. 11 without the necklace to illustrate connectivity between tube and pendant by interaction of two matching layers of grip tape.

The embodiment further relates to FIG. 11 which shows a lipstick tube 43 connected to a necklace 39 through a decorative coupling 56. In the example presented, the coupling is in the form of a cup containing a circular layer of grip tape at the inside, firmly attached to the bottom side of the cup, and wherein a tube 43 also containing a grip tape layer 45 attached to a terminus and illustrated in a plan view in FIG. 11C, is inserted into said cup. Pressing the tube into the cup forms a stable grip tape bond. A vertical section view of coupling 56 intended to show eyelet 38 and grip tape lining 46 is presented in FIG. 11A, while FIG. 11B is a view of 56 from the top to show the position of eyelet 38. A vertical section view of FIG. 11 is presented in FIG. 11D to illustrate coupling 56 with grip tape layer 46 facing layer 45 attached to the tube 43, and wherein the tube interior is indicated schematically. Although either end of the tube can serve as the attachment site to coupling 56, the drawing shows the tube cap as attachment site with the implied provision of a reliable friction fit between tube body and tube cap. This arrangement fosters the convenience of facile lipstick removal and application.

Figure 12A:
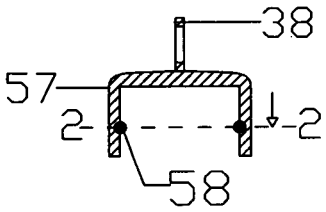
FIG. 12A is a section view of the coupling of FIG. 12 with an O-ring at the inside.
Figure 12B:
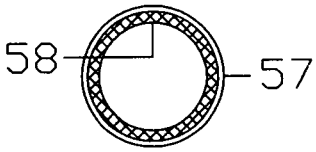
FIG. 12B is a cross-section view of the coupling of FIG. 12A to delineate the O-ring.
Figure 12:
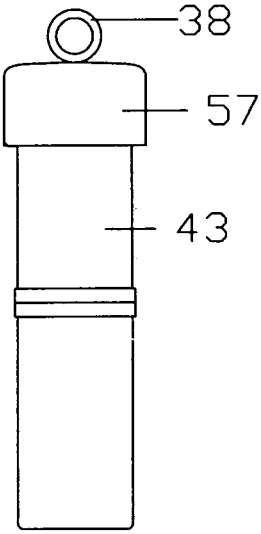
FIG. 12 is a plan view of a lipstick tube connected to a coupling where connectivity between tube and coupling is achieved by friction fit via O-ring.

The embodiment further relates to FIG. 12 which shows a lipstick tube 43 with a coupling 57. This coupling consists of a cup with eyelet 38, shown in a section view in FIG. 12A, detailing an internal circular groove fitted with an O-ring to provide friction fit between tube 43 and coupling 57. The O-ring has an inner toroidal diameter that is slightly smaller than the diameter of the tube 43 so that the coupling 57, through the interaction with the O-ring, can accept and hold the tube after pushing it, past the position of the O-ring, into the interior of the coupling 57. A section view of FIG. 12A along the plane 2-2 is seen in FIG. 12B to reveal the relative O-ring dimension.

Figure 13A:
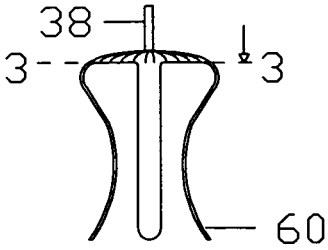
FIG. 13A is a plan view of the pendant prior to tube insertion.
Figure 13B:
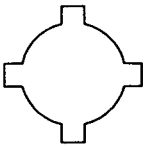
FIG. 13B is a cross-section view of FIG. 13A at the origin of the claws.
Figure 13:
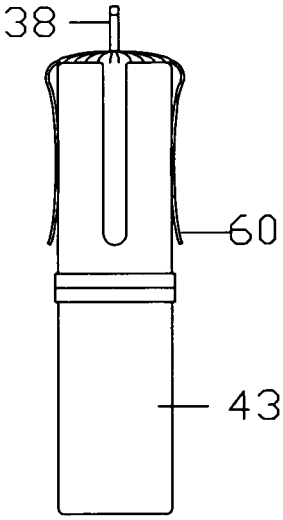
FIG. 13 is a plan view of a lipstick tube connected to a pendant comprising four claws emanating at the periphery of the pendant to hold the tube by friction fit.

The embodiment also relates to FIG. 13 which shows a lipstick tube 43 attached to a pendant comprising springy claws 60 and an eyelet 38. A separate illustration of the pendant is seen in FIG. 13A to reveal a base plate on top from which four springy claws emanate downward, and wherein the claws provide a cage that is physically restricted in the center but wider at the bottom to form an opening at the bottom so that a lipstick tube can be inserted and be held in place by friction fit. A top view of this pendant is shown in FIG. 13B, and created by a horizontally bisecting the interphase between the base plate and the four emerging claws as shown by plane 3-3. For additional security, and to extend the use of the coupling to tubes with unsuitable surfaces or narrower diameters, the underside of said base plate can optionally be layered with grip tape to accept a tube with a corresponding grip tape layer at the top as previously illustrated in FIG. 11C.

Figure 14A:
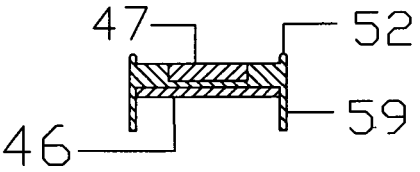
FIG. 14A is a section view of the adapter that mediates connectivity to the lipstick tube with grip tape layer interaction and to the necklace clasp by magnetic interaction.
Figure 14C:
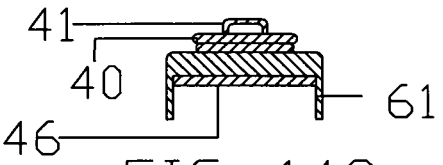
FIG. 14C is a section view of the adapter seen in a plan view as part of FIG. 14E, which mediates the connectivity to the tube via grip tape interaction and to the necklace pendant via hook and loop.
Figure 14B:
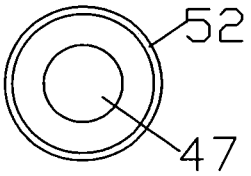
FIG. 14B is a view of the lipstick tube in the direction of the longitudinal axis to illustrate position of the magnetic insert and the rim at the periphery to retard sideways slippage of the magnetic clasp.
Figure 14D:
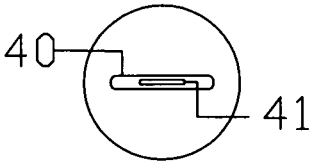
FIG. 14D is a view of the adapter of FIG. 14C from the top to illustrate the position of the loop.
Figure 14:
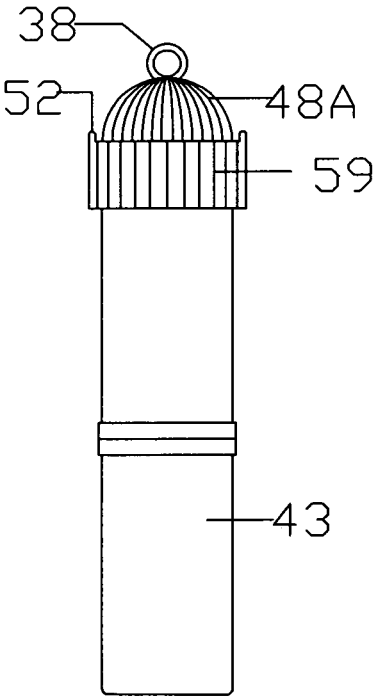
FIG. 14 is a plan view of a lipstick tube connected to a magnetic necklace clasp with the intermediacy of an adapter.

The embodiment also relates to FIG. 14 which shows a lipstick tube 43 with an adapter 59 that mediates connectivities to tube 43 on one end and to an appendage or clasp for attachment to a necklace on the other. The general formats of these interphases can be manifold; their common purpose is to connect a commercial tube without, or with only minimal physical changes, to one side of the adapter, and to equip the other side with connectivity means toward a large variety of necklace clasps.

The adapter 59 in FIG. 14A establishes connectivity to the tube by grip tap interaction with layer 46 inside of the adapter and a matching grip tape layer at the tube as previously illustrated in FIG. 11C. For connectivity of the adapter to the pendant at the necklace, a magnetic interphase is shown. The magnetic element at the adapter 59 is provided by implant 47 while clasp 48A provides the complimentary magnetic insert at the contact surface. The side wall of adapter 59 is slightly extended at the upper periphery to form a rim 52 to prevent side-ways slippage of the clasp 48A. A view of the adapter from the top is seen in FIG. 14B to show the rim 52 and the position of the magnetic insert 47. Inspection of FIG. 14 makes it apparent that a second adapter of the type 59 at the opposite side of the tube, together with a second magnetic clasp such as 48B, shown previously in FIG. 9A, and together with an additional grip tape layer at the second tube terminus, results in the opportunity to wear the tube horizontally at the necklace. Leashing the eyelets at 48A and 48B is a further option to increase safety against unintended disengagement.

Figure 14E:
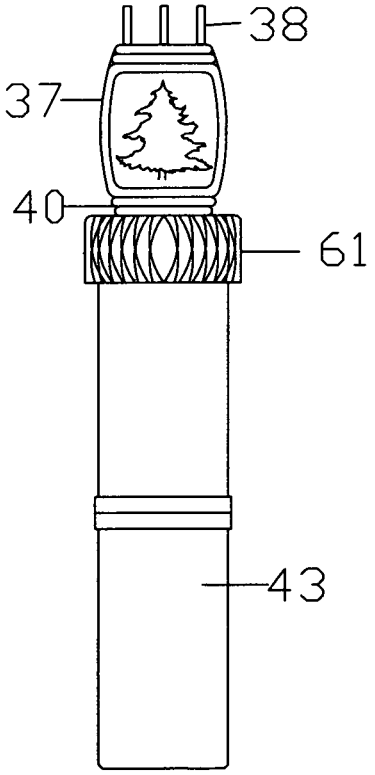
FIG. 14E is a plan view of the lipstick tube connected to a necklace clasp with the intermediacy of the adapter shown in FIG. 14C.

As a further illustration of the adapter utility, a version 61 is shown in a section view in FIG. 14C, and in a view from the top in FIG. 14D, where the grip tape connectivity toward the tube is maintained as delineated above in adapter 59, but the upper part of 61 contains the decorative hook element 40 of FIG. 8B so that the arrangement shown in FIG. 8 can be imitated as seen in FIG. 14E wherein the only required change at the tube consists of an added grip tape layer.

Figure 15A:
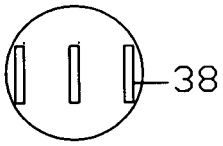
FIG. 15A is a view of FIG. 15 from the top.
Figure 15:
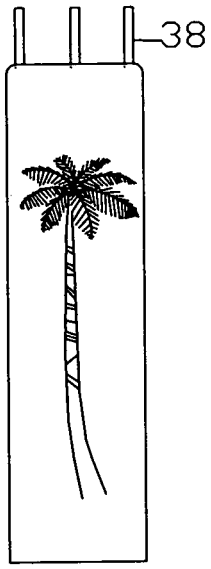
FIG. 15 is a plan view of a decorative appendage to a necklace that largely hides a lipstick tube from frontal view.
Figure 15B:
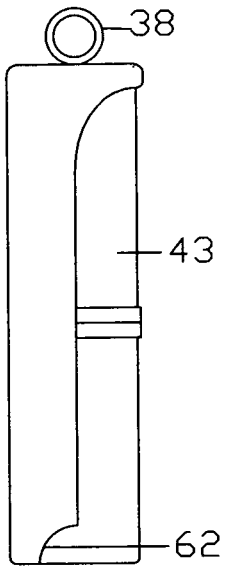
FIG. 15B is a view of FIG. 15 from the side.
Figure 15C:
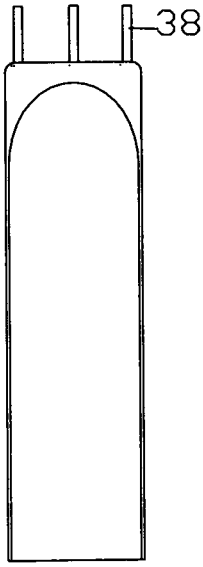
FIG. 15C is a rear view if FIG. 15.
Figure 15D:
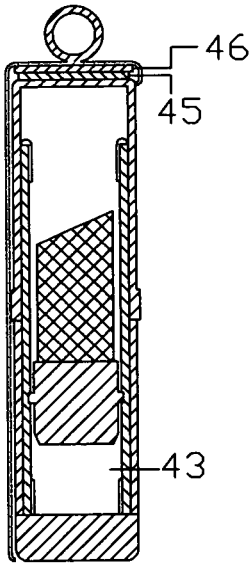
FIG. 15D is a section view of FIG. 15B to illustrate the connection between appendage and tube by matching layers of grip tape.

The embodiment also relates to FIG. 15 which is a plan view of a pendant that consists of a tubular body with a closed top bearing three eyelets 38. A top view of FIG. 15 is shown in FIG. 15A. The tubular wall of the pendant is open in the back and partially open on the side as delineated in a side view in FIG. 15B which also shows the position of the lipstick tube 43. A rear view of the pendant is seen in FIG. 15C to illustrate ease of access to the tube (tube not shown). As illustrated in FIG. 15B the lipstick tube is mostly hidden from a frontal view and is attached to the top of the pendant by the interphase of grip tape layers 45 at the tube and 46 at the pendant. This interaction between tube and pendant is delineated schematically in a section view in FIG. 15D that corresponds to the side view in FIG. 15B. To further facilitate access to the lipstick, the lower part of the tube body features two small quarter-round cutouts 62, diametrically arranged as indicated in FIG. 15B, to expose most of the rotator. Grasping tube and pendant at the upper part with two fingers and simultaneously pulling the tube at the rotator separates the cap from the lipstick tube while leaving the cap safely in place and freeing the lipstick for application. Complete removal of the tube 43 from the pendant is readily accomplished by breaking the grip tape interaction between 45 and 46 without disturbing the decorative display of necklace and pendant.

Figure 16:
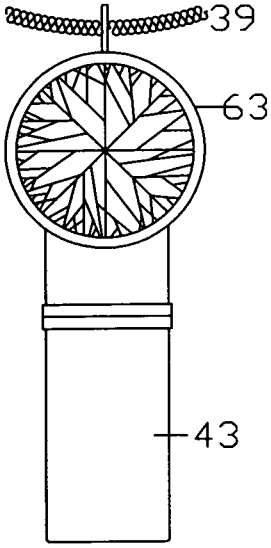
FIG. 16 is a plan view of a decorative décor comprising lipstick tube and a coupling on a necklace.
Figure 16A:
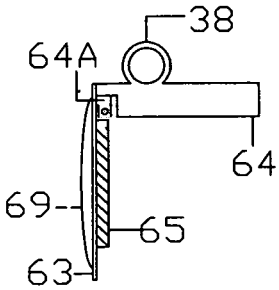
FIG. 16A is a side view of the coupling related to FIG. 16.
Figure 16B:
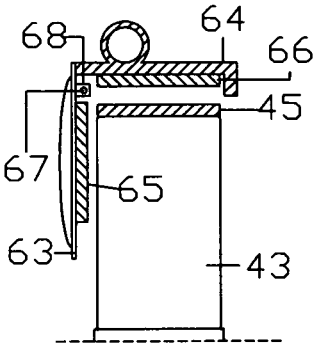
FIG. 16B is a section view of FIG. 16A and a partial plan view of the lipstick tube prior to full insertion into the coupling to illustrate connectivity between tube and coupling by grip tape interaction.
Figure 16C:
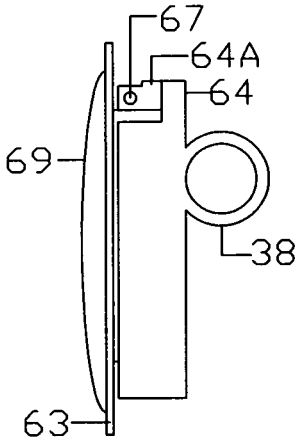
FIG. 16C is an enlarged plan view of FIG. 16A wherein the tube receptacle has been closed by a 90 degree clockwise rotation.
Figure 16D:
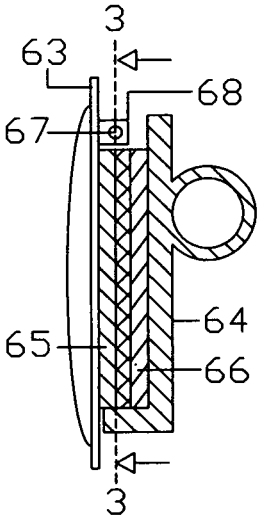
FIG. 16D is a section view of FIG. 16C.
Figure 16E:
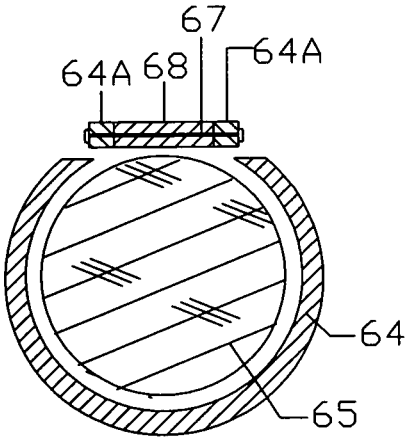
FIG. 16E is a cross-section view of FIG. 16D.
Figure 16F:
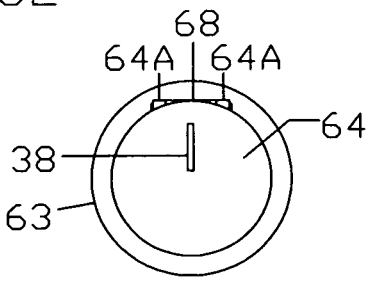
FIG. 16F is a plan view of FIG. 16C without enlargement as seen in the direction from the eyelet toward the bezel.
Figure 16G:
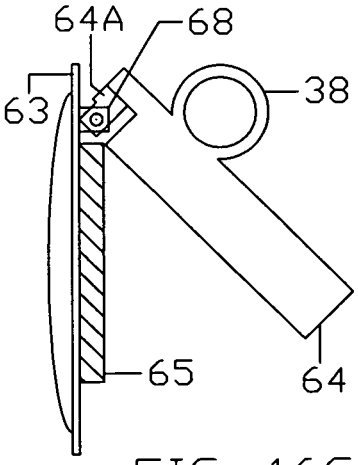
FIG. 16G is an enlarged plan view of FIG. 16A shown in the process of closing.

The embodiment also relates to FIG. 16 which illustrates an assembly comprising a coupling 63, a lipstick tube 43, and a necklace 39. The attachment of tube 43 to 63 is materialized by an extension 64 that is part of the coupling 63 and pivotably movable from a vertical to a horizontal position as shown in a side view in FIG. 16A. This graph also illustrates the bezel 69 in the front, a grip tape layer 65 on the backside, and an eyelet 38 at the top. In this position, the extension 64 exposes the bottom side for acceptance of the lipstick tube 43. This connectivity between 43 and 64 is indicated in FIG. 16B which shows a vertical section view of FIG. 16A together with the overlay of a partial plan view of the tube 43 but, in favor of explicitness, the grip tape layers 45 and 66 are not connected. The attached tube 43 can be disconnected from the body of the coupling 63 by breaking the grip tape bond between 45 and 66 and subsequent pivoting of the extension 64 around the axle 67, as seen in an enlarged side view in FIG. 16C, into a vertical position. This realignment creates a new grip tape interphase between 66 and 65 and generates a solid connection between extension 64 and the main body of the coupling 63. This rotation of 64 into the vertical position also relocates the eyelet toward the back of the unit as seen in the enlarged side view of 63 in FIG. 16C. A vertical section view of FIG. 16C is seen in FIG. 16D to emphasize the new grip tape interphase between 65 and 66 and to view the socket 68 that is firmly attached to the main body of the coupling 63 and which houses the axle 67 in the center. A section view of FIG. 16D along the plane 3-3 is shown in FIG. 16E to delineate the grip tape layer 65 in the center surrounded by the perimeter of 64 and the pair 64A. This pair is a part of 64 and flanks the sides of socket 68 to which it is pivotably connected via the axle 67. A view of the pendant 63 from the back is shown without enlargement in FIG. 16F where the extension 64 has been repositioned to coplanarity with the main body of 63. As depicted in this graph, the socket 68 is flanked by the pair 64A that establishes connectivity to 64. FIG. 16G is an enlarged side view of coupling 63 but where the extension 64 is rotate by 45 degrees and drawn as an overlay to better illustrate the pivot area between 64A and socket 68.

Figure 17A:
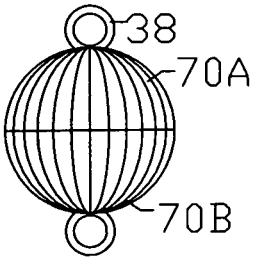
FIG. 17A is a plan view of the clasp comprising two symmetrical halves.
Figure 17B:
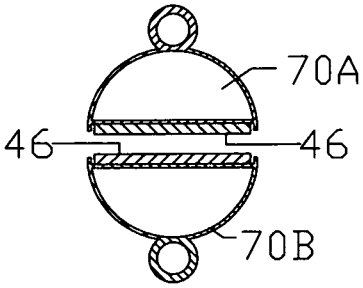
FIG. 17B is a section view of the clasp halves, each exposing a grip tape layer.
Figure 17C:
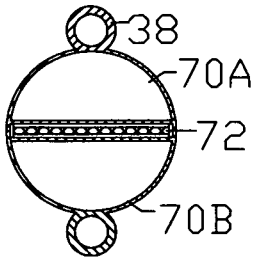
FIG. 17C is a section view of FIG. 17A with emphasis on grip tape interaction.
Figure 17:
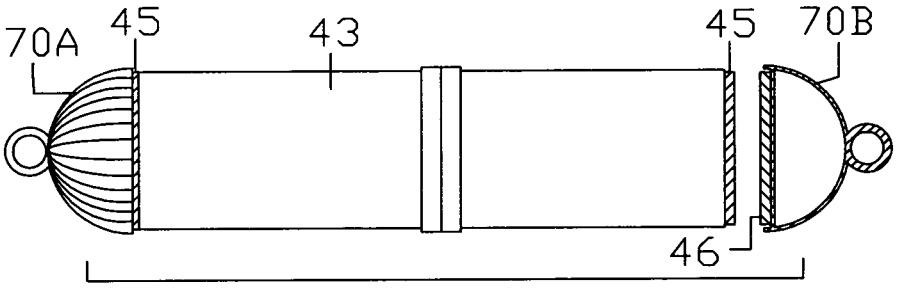
FIG. 17 is a plan view of a lipstick tube intercalated into a clasp comprising two symmetrical halves with grip tape layers at the surfaces, and wherein the lipstick tube has grip tape sections at both termini and wherein the left side shows full connection of clasp and tube while the right side illustrates tube terminus and clasp in a state of disengagement.

The embodiment also relates to FIG. 17 which shows a lipstick tube 43 intercalated into a clasp consisting of two symmetrical halves 70A and 70B and wherein contact and adhesion between tube and clasp halves is created by grip tape layers 45 and 46 at the tube termini and at the contact surfaces at 70A and 70B, respectively. FIG. 17 shows the tube 43 in connection with 70A, while 70B, shown in a section view, is disconnected from the tube to detail the grip tape layers 45 and 46. The assembled clasp is seen in a plan view in FIG. 17A. The clasp is created by envisioning the clasp shell to be bisected through the center and by installing a floor at each resulting clasp half wherein each floor is recessed and wherein the distance between the floors is slightly smaller than the thickness of a pair of grip tape layers after pressing them together. A section view in FIG. 17B illustrates the extent of the floor recession and the space occupied by the individual grip tape layers. FIG. 17C shows the same layers after pressing the two clasp halves together. The resulting layer interphase 72 is equally shared by both layers.

It is appreciated that a given clasp as illustrated in FIG. 17A can be intercalated by a lipstick tubes with a certain tolerance toward tube dimensions. While the grip tape layers in the assembled clasp are hidden from view, an intercalated commercial tube, however, exposes a small section of the grip tape layer 45 attached to the tube and illustrated on the left side in FIG. 17.

Figure 18A:
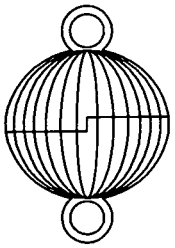
FIG. 18A is a plan view of the clasp comprising two antipodal halves.
Figure 18B:
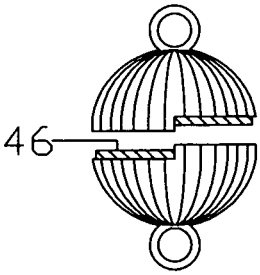
FIG. 18B is a plan view of the individual clasp halves with emphasis on the grip tape layers in each.
Figure 18C:
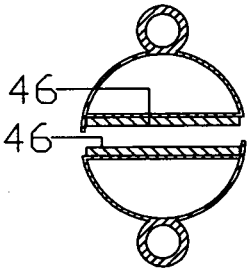
FIG. 18C is a section view of FIG. 18A.
Figure 18:
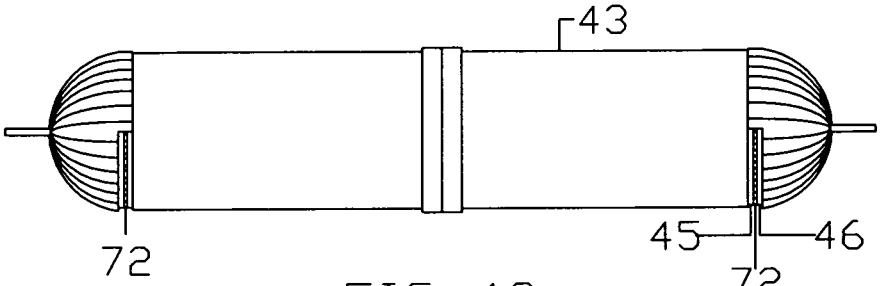
FIG. 18 is a plan view of a lipstick tube intercalated into a clasp comprising two antipodal halves with grip tape layers at the surfaces, and wherein the lipstick tube has grip tape sections at both termini to allow adhesion between tube and clasp.

To conceal the grip layer interphase in a front view of a tube that is worn horizontally on a necklace, the embodiment relates to FIG. 18 which shows a tube 43 intercalated into a clasp as detailed in FIG. 18A and wherein said clasp is created by visualizing the bisection the outer wall of the spherical object with two parallel planes, commencing at the surface, and equidistant from the center, but proceeding in opposite direction toward the center of the sphere and wherein the distance between the bisecting planes is slightly less than the thickness of a pair of grip tape layers after pressing them together. The separated two halves show their antipodal relationship and the location of the grip tape layers 46 that clads the circular contact surface in each. A vertical section view is presented in FIG. 18C to show the grip tape layers 46 and the contours of the clasp surface. As evident from FIG. 18, one of the two halves of the clasp is turned by 180 degrees resulting in grip tape interphases 72 located at the same side of the tube so that the assembly can be worn horizontally where the layer interphase is concealed in a frontal view.

Figure 19A:
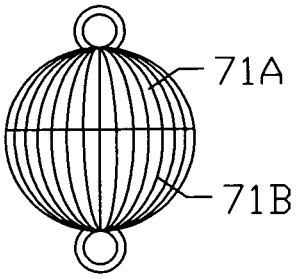
FIG. 19A is a plan view of the clasp comprising two unsymmetrical halves.
Figure 19B:
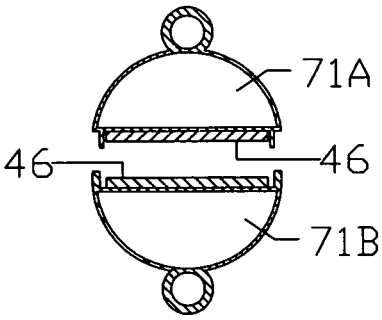
FIG. 19B is a section view of the individual clasp halves with emphasis on the grip tape layers in each.
Figure 19C:
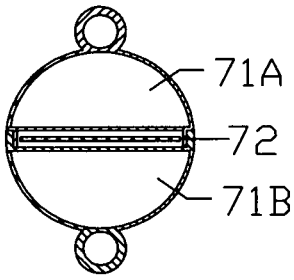
FIG. 19C is a section view of FIG. 19A.
Figure 19D:
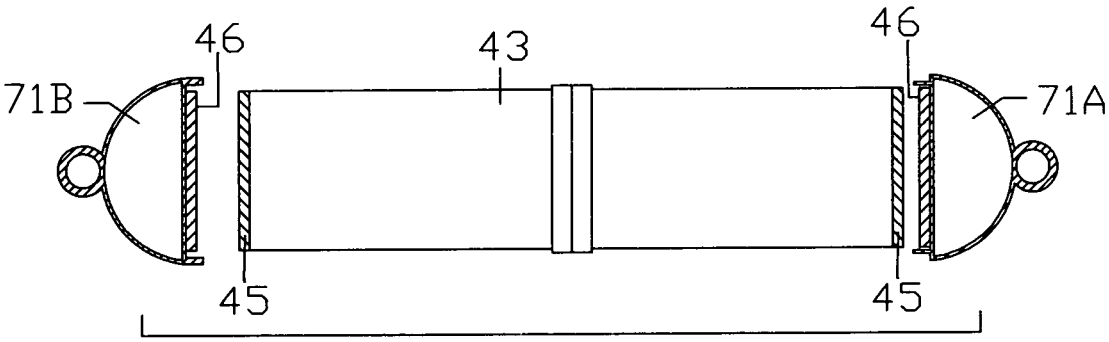
FIG. 19D details the clasp sections of FIG. 19B prior to intercalation into the tube where the tube is shown with grip tape layers at the termini.
Figure 19:
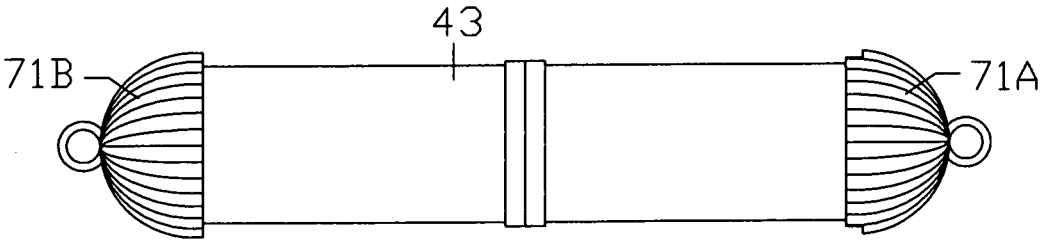
FIG. 19 is a plan view of a lipstick tube intercalated into a clasp comprising two unsymmetrical halves wherein the contact interphases are hidden from view due to the clasp construction.

To completely conceal the grip tape layer interphases 45/46 at both tube termini from all views upon wearing the tube horizontally on a necklace, the embodiment relates to FIG. 19. This arrangement employs a clasp shown in a plan view in FIG. 19A and consists of two unsymmetrical halves 71A and 71B whose creation can be envisioned by cutting a sphere with three planes, equidistant from each other, and wherein the distance between the two outer planes is slightly less than the thickness of a pair of grip tape layers after pressing them together. As a result, two identical rings are formed, one of them is envisioned to be reduced in size to fit into the space provided by the other, and both rings, now of unequal size, are visualized to be connected centrally to the circular surfaces of the two cap-like portions created by the cutting planes. The appearance of the resulting clasp is shown in FIG. 19B where the floors are clad by grip tapes. The assembled clasp is illustrated in a plan view in FIG. 19A and in a section view in FIG. 19C, together with the compressed grip tape layers in the center wherein the shading has been restricted to the layer interphase 72. FIG. 19D details the clasp sections of FIG. 19B prior to intercalation into the tube where the tube is shown with grip tape layers at the termini.

It is appreciated that certain grip tape interphases form very strong bonds. If applied to a grip tape clasp as elaborated herein, it may be required to reduce the contact surfaces of the layers, or to change the shape of the clasp from a spherical to a more cylindrical appearance to allow more finger pressure toward bond breakage.

Figure 20:
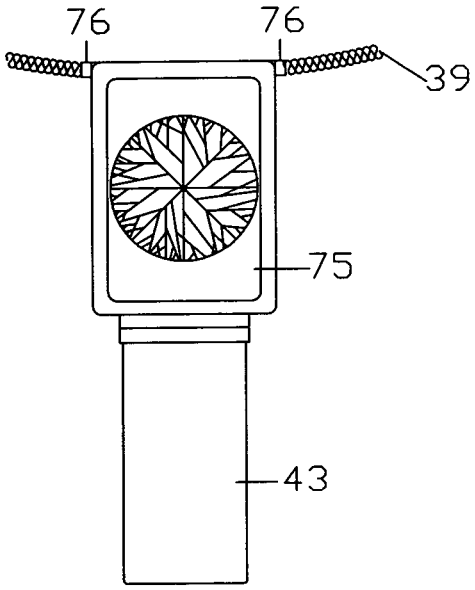
FIG. 20 is a plan view of an appendage with a lipstick tube and wherein the appendage is connected to a necklace via tongue and groove.
Figure 20B:
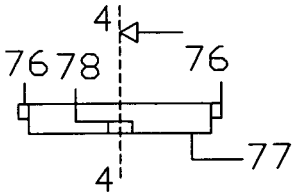
FIG. 20B is a plan view of the tongue section.
Figure 20C:
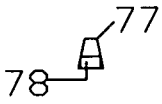
FIG. 20C is a cross-section view of FIG. 20B to show the detent element.
Figure 20D:
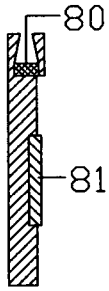
FIG. 20D is a section view of the appendage shown in FIG. 20A as seen from the side.
Figure 20E:
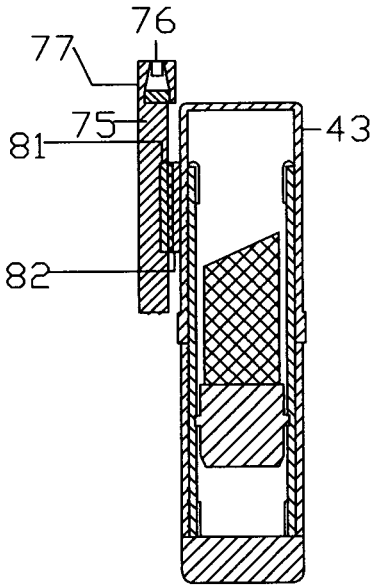
FIG. 20E is a section view of the appendage and tube shown in FIG. 20 as seen from the side to emphasize connectivity via grip tape layer interaction.
Figure 20A:
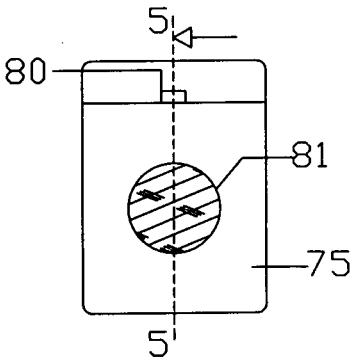
FIG. 20A is a rear view of the appendage shown in FIG. 20 without necklace and tongue section.
Figure 20F:
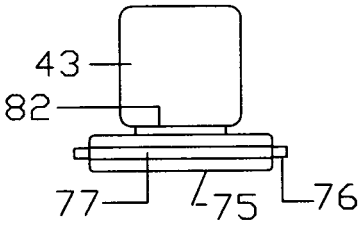
FIG. 20F is a top view of FIG. 20 without the necklace.

The embodiment also relates to FIG. 20 that shows a decorative, flat appendage 75 partially concealing an attached lipstick tube 43. The backside of 75, as shown in FIG. 20A, is clad in part by a grip tape layer 81 that can mediate the wearing of a lipstick tube, or alternatively any other small object, provided that one side of such an object is attachable to a grip tape section 82 that can interlock with layer 81 at the appendage. Among the lipstick tubes, those with prismatic shape are particularly suitable as they present a flat side to accept a grip tape layer 82 for coplanar engagement with 81. Appendage 75 features a groove section on top that can slidably engage with a corresponding tongue section 77 at the necklace as seen in a side view in FIG. 20B. The center of section 77 houses a magnetic detent component 78 and connectivity elements 76 at the side for the attachment to the necklace 39. The contours of the detent partners 78 in the tongue section 77 and of 80 in the groove section of 75 were added schematically to the plan views in FIGS. 20A and 20B as overlays to indicate size and position. FIG. 20C is a section view along the plane 4-4 in FIG. 20B and details the contours of tongue section 77 and detent 78. A vertical section view of 75 along the plane 5-5, as indicated in FIG. 20A, is seen in FIG. 20D and details the groove space, the magnet detent 80 located below the groove surface, and a slightly recessed circular area to accommodate the grip tape section 81. FIG. 20E is a vertical section view corresponding to a side view of FIG. 20 to show tube 43 with the grip tape layer contacts between 81 located at the appendage 75 and 82 located at the tube 43. FIG. 20F represents a top view of the assembled unit as seen in FIG. 20 and shows tube 43 with grip tape layer 82, appendage 75, and slider 77 with necklace connectivity elements 76.

The embodiment also relates to lipstick tubes that can be refilled. This option is preferred for valuable tubes with the intention to keep them in use over an extended period of time and is realized by tube modifications previously described in the patent literature, especially in U.S. Pat. No. 2,921,675. Notwithstanding the multitude of the published inventions as set forth previously, significant further improvements, directed toward facile pomade removal or exchange, are part of the embodiment.

Figure 21:
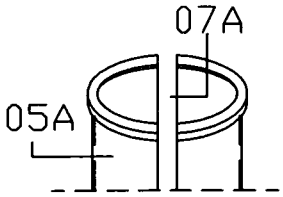
FIG. 21 is a perspective view of the required modification of the vertical slots at the inner sleeve to enable the lipstick exchange operation.
Figure 22:
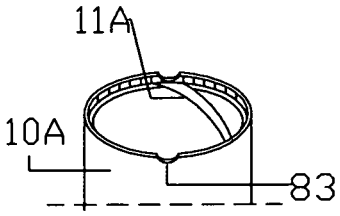
FIG. 22 is a perspective view of the required modification of the central sleeve bearing the helical grooves for the lipstick exchange operation.
Figure 23:
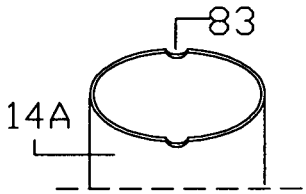
FIG. 23 is a perspective view of the required modification of the outer sleeve for the lipstick exchange operation.
Figure 24:
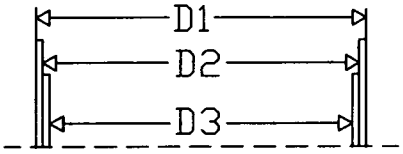
FIG. 24 illustrates a rabbet cut in the central sleeve.

The modifications required for the lipstick exchange operation, intended primarily for tubes with swivel-mechanisms, occur at the top of the sleeve assembly where the sleeves 05, 10 and the outer sleeve 14 are changed to 05A, 10A, and 14A, as schematically shown in FIGS. 21 to 23. The important feature of the aforementioned sleeve modification is manifest by unobstructed coaxial insertion of the lugs 03, which are part of the cup 01, through the slots 07A in sleeve 05A into the helical grooves 11A present in the central sleeve 10A. The outer and inner diameters of the central sleeve 10A are defied by D1 and D3, respectively, the depth of the helical grooves and the depth of the rabbet cut as defined herein is D2-D3 and shown in FIG. 24. To enable this access, the slots 07 in sleeve 05 have to be extended to the top as seen in FIG. 21 and must include a resection of the segment of any outwardly protruding toroidal rim to a point where the diametric distance between the resected toroidal rim as viewed perpendicular to the longitudinal axis is equivalent to the distance D2.

Figures 1B, 1C, 1D, 1E:
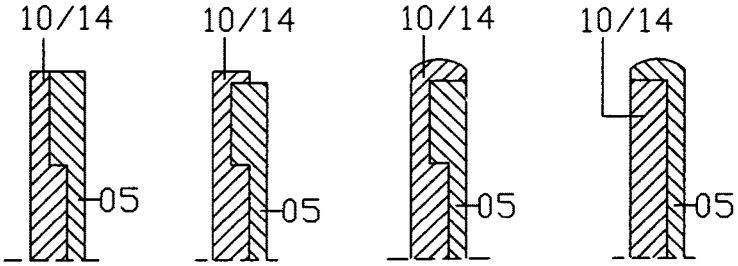
FIG. 1B shows the wall interactions between the inner sleeve and the central sleeve via a rabbet cut in the central sleeve.
FIG. 1C shows the wall interactions between the inner sleeve and the central sleeve via a groove cut in the central sleeve.
FIG. 1D shows the wall interactions between the inner sleeve and the central sleeve via a groove cut with a projection.
FIG. 1E shows the wall interactions between the inner sleeve and the central sleeve wherein the inner sleeve provides a rim that covers the perimeter of the central sleeve. (prior art)
Figure 25:
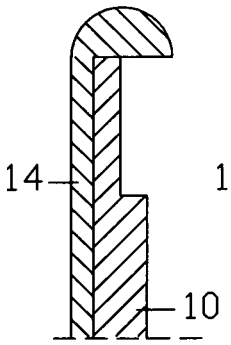
FIG. 25 details the left side of a section view of a popular projection commencing at the outer sleeve and overarching the central sleeve to imitate a groove cut in the central sleeve.
Figure 26:
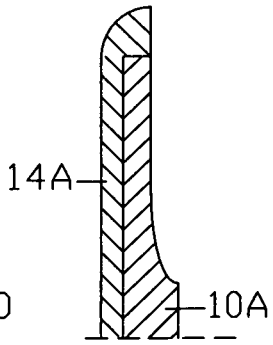
FIG. 26 details the left side of a section view of the required resection of the projection shown in FIG. 25 and the continuation of the vertical path from the onset of the resection in the outer sleeve to the helical grooves in the central sleeve.

Although sleeves 10 and 14, shown in FIG. 1A, are usually present as a unit, some constructions are devoid of sleeve 14 so that the two modified sleeves 10A and 14A are shown separately as illustrated in FIGS. 22 and 23. As seen in the examples of sleeve 10/14 in FIGS. 1B to 1E and in FIG. 25, the assurance of unobstructed coaxial access of the lugs 03 throughout the sleeve assembly requires appropriate rim resections. This process is exemplified by the conversion of the sleeve portrayed in FIG. 25 to the version seen in FIG. 26 and is performed in a narrow vertical segment in the projection of the groove cut shown in FIG. 25 to arrive at the resected version seen in FIG. 26 and is carried out at two diametrically opposed locations, exactly at the position where the helical grooves terminate or where they intersect with the groove cut. The width of the resection conforms to the width of the helical groove or, in other words, not less than the diameter of lug 03 and not more than the width of the slot 07A. If the helical grooves in the central sleeve terminate before they reach the upper end of the sleeve, which is very likely in sleeve constructs shown in FIG. 1E, these grooves must also be extended to the end of the sleeve, in the form of a vertical continuation of the grooves in the longitudinal direction of the tube. This desired continuum within sleeve 10A ranges from the upper end of the resected rim in the sleeve that provided the toroidal projection to the onset of the helical grooves in the central sleeve as exemplified in the section view of FIG. 26 (only one side of the sleeve is shown).

Figure 27:
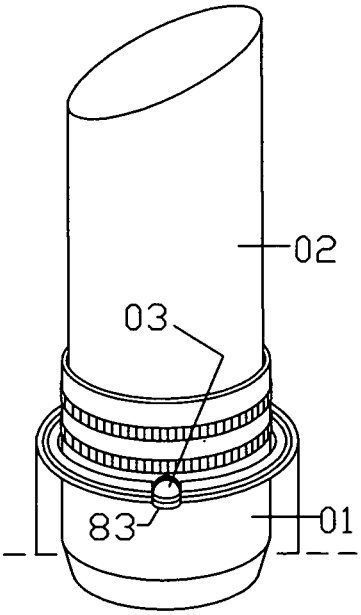
FIG. 27 is a perspective view to illustrate the position of the lipstick cup after insertion into the sleeve assembly with emphasis on the required sleeve alignment and the position of cup and lipstick for the lipstick exchange operation.

To assure expeditious lipstick exchange, it is imperative to enable recognition of the congruence of the slots 07A, located at the inner sleeve, with the upper end of the helical grooves 11A located inside the central sleeve, or with the above-mentioned vertical helical groove extensions. To achieve this, the outer wall of the central sleeve, defined by D1-D2 in FIG. 24, receives a mark, visible in a side view, and materialized most simply in the form of a very shallow and narrow notch or cutout 83 at the perimeter, and applied at the position in sleeve 10A where the vertical connections to the helical grooves commence. These shallow cutouts make the projected groove location discernable in a side view as illustrated in FIG. 22. In the presence of a sleeve 14, these marks 83, seen in FIG. 23, must extend congruently through both sleeves 10A and 14A. To establish congruence between the marks 83 and slots 07A, the sleeve assembly is held with two fingers, the assembly is viewed from the side and the rotator is turned until the cutouts 83 at sleeve 10A/14A superimpose with the slots 07A at the inner sleeve. The resulting sleeve alignment is portrayed in an oblique view in FIG. 27 which also shows the partially inserted cup 01 with lipstick 02 and the cylindrical protrusion 03 as an overlay to the sleeve assembly. The positions of the notches 83 are in alignment with slots 07A at the inner sleeve and with the lugs 03 emanating from the cup 01 so that the cup 01 could now be pulled out or pushed deeper into the helical grooves.

Figure 28:
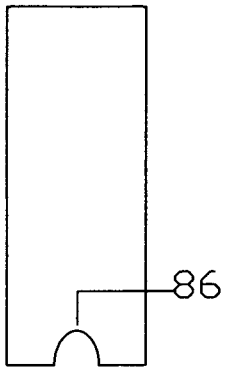
FIG. 28 is a plan view of the protective sleeve that is part of the lipstick cartridge.
Figure 28A:
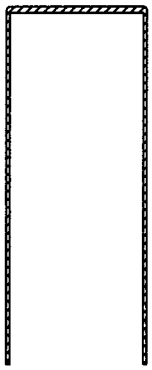
FIG. 28A is a section view of FIG. 28.
Figure 28B:
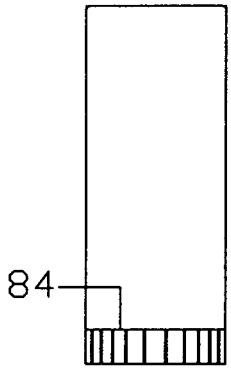
FIG. 28B is a plan view of the protective sleeve shown in FIG. 28 wherein the hemi-elliptical cutout at the bottom is replaced with vertical incisions.
Figure 29:
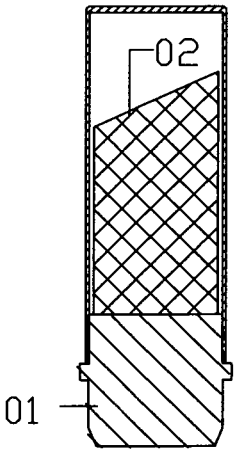
FIG. 29 is a section view of the lipstick cartridge comprising protective sleeve, cup and lipstick.
Figure 29A:
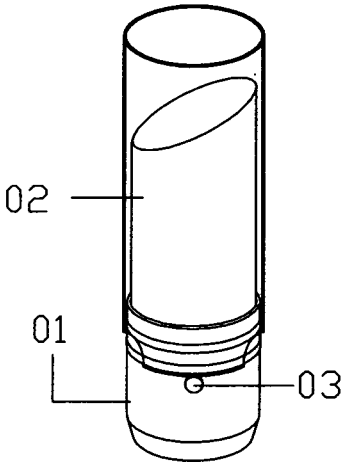
FIG. 29A is a perspective view of FIG. 29 as seen from the side.
Figure 30:
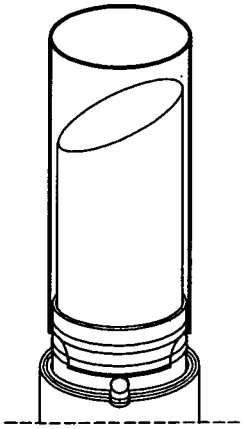
FIG. 30 is a perspective view of the lipstick cartridge at the onset of insertion into the sleeve assembly.
Figure 30A:
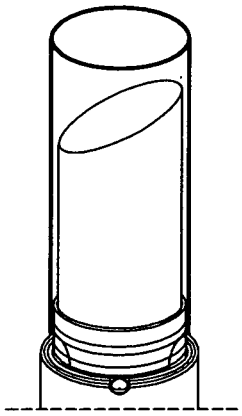
FIG. 30A is a perspective view of the lipstick cartridge after full insertion into the sleeve assembly.

The replacement lipstick is protected by a temporary cap shown in a plan view in FIG. 28 and formed from transparent materials readily moldable into the required configuration; a preferred wall thickness of 0.1 to 0.5 mm was found to provide sufficient protective strength. A vertical section view of the temporary cap is presented in FIG. 28A. This cap, together with cup 01 and the pomade 02, and referred to as the cartridge, is shown in a vertical section view in FIG. 29 and in an oblique view in FIG. 29A where the cup was turned by 90 degrees. After removal of a spent lipstick, consisting only of cup 01, a new cartridge is inserted into the grooves 11A of sleeve 10A. This insertion commences by aligning the slots 07A of sleeve 05A with the cutouts 83 present in sleeves 10A and 14A as delineated above. A view of this alignment, prior to insertion of the lugs into the sleeve assembly, is seen in FIG. 30. Gentle downward pressure from the top can proceed until the temporary cap touches the sleeve assembly of the tube as illustrated in FIG. 30A. In most sleeve architectures the protrusions 03 are now located in the groove territory and are flanked by the vertical slots 07A so that full insertion has been achieved and no further manual push directed toward engagement of the lugs 03 with the helical grooves is required. In the next step the temporary cap has to be removed. To facilitate this operation, the temporary cap has been equipped with two diametrically placed cutout 86 at the lower perimeter, as seen in FIG. 28, to fulfill two purposes. The cutouts do not infringe on the seal quality between cap and cup 01 but afford a more tenuous fit so that disengagement of the cap from cup 01 is facilitated while providing sufficient friction contact for safe handling and storage of the cartridge. The second purpose of the cutouts 86 is to expose additional surface area of the cup 01 while the temporary cap is still in place. This added area aids in any manual assistance for the cap removal. This manual intervention is minimal and is only intended to break the seal between cup and cap, for without the need to loosen this interphase by sleeve intervention; the impulse required by the rotator is limited to lipstick transport thus preserving the integrity of the delicate interior tube components. Depending on the cap construction, the replacement of the cutouts 86 with vertical incisions 84 as illustrated in FIG. 28B may be indicated.

To remove the spent lipstick, or to exchange a functional lipstick with a different one, turning the rotator is continued until the cup 01 becomes visible and then further until the protuberances 03 reach the surface of the sleeve assembly as seen in FIG. 30A. As the cup emerges from the sleeves, the temporary cap is placed over the cup and grasping the area of the cutouts allows the thus reconstituted cartridge to be lifted from the sleeve assembly.

To refill, a new cartridge is withdrawn from a storage box and inserted coaxially into the tube with the sleeve alignment as seen in FIG. 30. Applying gentle pressure in the coaxial direction of the sleeves will force the protuberances 03 into the slots 07A and into the grooves 11A. At this stage the temporary cap is loosened as described above and, provided that the grooves 11A are right-handed as shown in FIG. 21, a further clockwise rotation of the rotator, as viewed from the top, will pull cup and lipstick toward the interior in accordance with the mechanism elaborated previously.

The temporary cap is formed from transparent materials which are readily moldable into the appropriate shapes. Any thermo-formable plastic may be used such as ethylene or vinyl polymers or copolymers, acrylic resins, polyacetates and the like. Most preferred are polyethylene terephthalate, styrene polymers and copolymers, and polyvinylchloride. The preferred material for a box which houses the cartridges is poly(methyl methacrylate).

The materials used in the fabrication of lipstick tubes include metal and plastic materials, or a combination thereof. Plastic materials are most popular due to their low friction coefficients and their availability in great varieties of colors, strength, and flexibility. Lipstick tubes fabricated of aluminum have the advantage of light weight and are therefore particularly well suited as attachments to necklaces, especially in connections with magnetic clasps. Interior sleeves are usually fabricated from plastic materials with the intent to reduce friction. The materials used for the coupling can be adapted to the material used in the lipstick tube constructs and are evident to the practitioner and readily converted to practice by those skilled in the art.

INCORPORATION BY REFERENCE

The content of all references cited throughout this application are hereby expressly incorporated herein in their entireties by reference.

CONCLUSIONS, RAMIFICATIONS, AND SCOPE

Thus the reader will see that at one or more of the presented embodiments provide a more practical, lightweight, yet economical device that can be used by anyone who is in need of a lipstick and who appreciates lipstick as part of a decorative décor. The user will benefit from ready availability of the lipstick at a necklace and the extended variety of lipstick colors and compositions in a limited space. Together with the rapid lipstick exchange options, the use of costly and ornate lipstick tubes is encouraged as only few of such tubes are needed. The embodiments empower lipstick tubes to be ostentatious and decorative and to become part of jewelry; it is envisioned that a Lady arriving at a party or at her office to reach into her purse for a lipstick, then quickly connect it to her necklace to create a decorative arrangement and just as readily disconnect it whenever indicated. Since the lipstick tubes are interphased with couplings that allow ready connections and disconnections of the tubes, uninterrupted availability of the lipstick is assured, the decorative appeal of the coupling is preserved even without the attached lipstick, and economy is encouraged as the need for many lipstick tubes is reduced.

While the above descriptions contain much specificity, these should not be construed as limitations on the scope, but rather as examples of several preferred embodiments thereof. Many other variations are possible. For example, a coupling to a necklace that consists of a cup that holds a lipstick tube by friction fit via internal O-ring may contain several O-rings of different sizes, arranged coaxially with decreasing internal spaces for the tube, proceeding from the opening at the bottom to the top, to accommodate tubes of varying diameters. Similarly, a decorative appendage on a necklace, intended primarily to hold and partially conceal an attached lipstick tube, could also hide other small object such as a key, a flash drive, a watch, or any small electronic device provided that the proper attachment option is chosen. Although several couplings shown are planar, they could also be curved to conform closer to the shape of the lipsticks to which they are attached or provide semi cylindrical adapters at the backside. Grip tape layers have been employed frequently in these embodiments, but a variety of alternative attachment devices, designed to secure attachment of tube and appendage, such as snap-on clasps that resemble jean snap buttons, and the like, could be employed. Lipstick tubes held in place by apertures and matching brackets could be modified by changing the apertures to an indentation encompassing the entire perimeter of the tube in the form of a recessed hemi-torus and using a circular claw system to engage connectively with that opening and using a spring-activated engage- and disengage mechanism related to those in wrist-watch bands.

Some of the embodiments contained herein apply equally to lipstick tubes with push-up mechanisms and to those wherein the cross section of the pomade is not circular but rather elliptic or even rectangular. Such lipstick tubes can have flat profiles to match advantageously the flat shapes of some of the presented couplings and appendages.

Those skilled in the art will recognize, or be able to ascertain, using no more than routine experimentation, many equivalents of the specific embodiments described herein. Accordingly, the scope should not be construed as limited to the embodiments set forth herein, but by the appended claims and their legal equivalents.

That which is claimed:

1. A lipstick tube for dispensing and housing a lipstick comprising a tube having two ends, one end an opening where the lipstick emerges, and means for attachment to a wearable accessory thereby forming a union of tube and wearable accessory, wherein the accessory comprises a necklace, a pendant, or a brooch, and wherein the means for attachment comprise at least one clasp or at least one coupling located at the tube to disconnect and reconnect the union, and wherein the positions of the clasp or coupling attachment to the tube determine the tube orientation with respect to the body of a wearer, so that the tube orientation assumes a vertical position when the clasp or the coupling attachment is located at one end of the tube, or a horizontal position when the clasp or the coupling attachment is located at both tube ends or positioned in the tube center, and wherein the clasp comprises two matching and interlockable components to enable rapid connect and disconnect of the tube to and from the wearable accessory, the first component, attached to a tube end and comprising a snare or small loop and disposed to accept the second component comprising an appendage in the form of a hock or gaff, extending longitudinally and parallel to the body of the second component and in proximity thereof, and wherein connection between the two components occurs by sleeving the gaff of the second component into the snare of the first component, followed by vertical alignment of all clasp components with the longitudinal axis of the tube, thereby reconstituting the clasp's original appearance and shape, and wherein disconnection of the tube is achieved by sliding the gaff out of the snare of the first component.

2. A lipstick tube for dispensing and housing a lipstick comprising a tube having two ends, one end an opening where the lipstick emerges, and a means for attachment of the tube to a wearable accessory thereby forming a union comprising tube and wearable accessory wherein the accessory comprises a necklace, a pendant, or a brooch and wherein the means for attachment comprises at least one clasp or at least one coupling located at the tube to disconnect and reconnect the union and wherein the positions of the clasp or coupling attachment to the tube determine the tube orientation with respect to the body of a wearer and wherein the tube orientation assumes a vertical position when the clasp or the coupling attachment is located at one end of the tube, or a horizontal position when the clasp or the coupling attachment is located at both tube ends or positioned in the tube center;

wherein a section of the tube, located opposite to the opening where the lipstick emerges, contains means for attachment comprising a side-release buckle so that one end of the buckle comprises part of the tube while the other end is attached to the wearable accessory to result in a union comprising tube, buckle, and wearable accessory emphasizing the resistance to disconnection of the tube from the wearable accessory by unintended pulling.

3. A lipstick tube for dispensing and housing a lipstick comprising a tube having two ends, one end an opening where the lipstick emerges, and a means for attachment of the tube to a wearable accessory thereby forming a union comprising tube and wearable accessory wherein the accessory comprises a necklace, a pendant, or a brooch and wherein the means for attachment comprises at least one clasp or at least one coupling located at the tube to disconnect and reconnect the union and wherein the positions of the clasp or coupling attachment to the tube determine the tube orientation with respect to the body of a wearer and wherein the tube orientation assumes a vertical position when the clasp or the coupling attachment is located at one end of the tube, or a horizontal position when the clasp or the coupling attachment is located at both tube ends or positioned in the tube center;

wherein the means for attachment to the wearable accessory comprises protuberances, lugs, or pegs emerging at the side of the tube, wherein the wearable accessory has terminal loops and is either a necklace or a horseshoe-shaped loop comprising connectivity option to the necklace, and the protuberances are further modified at their ends by boules to enhance secure adherence to the ends of the necklace or the horseshoe-shaped loop.

4. A lipstick tube for dispensing and housing a lipstick comprising a tube having two ends, one end an opening where the lipstick emerges, and a means for attachment of the tube to a wearable accessory thereby forming a union comprising tube and wearable accessory wherein the accessory comprises a necklace, a pendant, or a brooch and wherein the means for attachment comprises at least one clasp or at least one coupling located at the tube to disconnect and reconnect the union and wherein the positions of the clasp or coupling attachment to the tube determine the tube orientation with respect to the body of a wearer and wherein the tube orientation assumes a vertical position when the clasp or the coupling attachment is located at one end of the tube, or a horizontal position when the clasp or the coupling attachment is located at both tube ends or positioned in the tube center;

wherein the tube contains a magnetic insert or a suitable unmagnetized ferromagnetic material located at the surface of one tube end, and wherein the tube end that contains the magnetic insert can connectively engage a magnetic counterpart located at the surface of an appendage connectable to a necklace thereby causing the tube to be wearable in a vertical position, or wherein both ends of the tube comprise magnetic inserts so that the tube can be connectively intercalated into a magnetic clasp consisting of two halves that are held together by matching magnets, each half of the clasp containing means for connectivity to the necklace, generating a continuous loop of the necklace with the tube as part therein, and wherein the ferromagnetic inserts in the tube are slightly recessed to prevent sideways slippage of the magnetic clasp component, and wherein a chain connects the ends of the magnetic clasp.

5. A lipstick tube for dispensing and housing a lipstick comprising a tube having two ends, one end an opening where the lipstick emerges, and a means for attachment of the tube to a wearable accessory thereby forming a union comprising the tube and the wearable accessory wherein the accessory comprises a necklace, a pendant, or a brooch and wherein the means for attachment comprises at least one clasp or at least one coupling located at the tube to disconnect and reconnect the union and wherein the positions of the clasp or coupling attachment to the tube determine the tube orientation with respect to the body of a wearer and wherein the tube orientation assumes a vertical position when the clasp or the coupling attachment is located at one end of the tube, or a horizontal position when the clasp or the coupling attachment is located at both tube ends or positioned in the tube center;

wherein the coupling comprises a pendant in the form of a cup, the cup containing means to mediate connectivity between necklace and tube, the top side of the cup opposite from the open side having connectivity means to the necklace comprising a suitable clasp component, and wherein a grip tape layer is installed inside of the cup so that friction fit between the cup and tube is enhanced by grip tape interaction and created by pushing the tube toward the bottom of the cup and wherein the tube is also equipped with a grip tape layer at the tube end thereby forming a stable but readily breakable interphase between tube and coupling.

6. A lipstick tube for dispensing and housing a lipstick comprising a tube having two ends, one end an opening where the lipstick emerges, and a means for attachment of the tube to a wearable accessory thereby forming a union comprising the tube and the wearable accessory wherein the accessory comprises a necklace, a pendant, or a brooch and wherein the means for attachment comprises at least one clasp or at least one coupling located at the tube to disconnect and reconnect the union and wherein the positions of the clasp or coupling attachment to the tube determine the tube orientation with respect to the body of a wearer and wherein the tube orientation assumes a vertical position when the clasp or the coupling attachment is located at one end of the tube, or a horizontal position when the clasp or the coupling attachment is located at both tube ends or positioned in the tube center;

wherein the coupling comprises a pendant in the form of a cylindrical or conical cup, the cup containing means to mediate connectivity between the necklace and the tube, the cup connectable to the necklace via eyelets on the top side and equipped with at least one internal circular groove on the inside that is fitted with O-rings to provide friction fit between the tube and the cup upon insertion of the tube.

7. A lipstick tube for dispensing and housing a lipstick pomade comprising a lipstick tube having two ends, one end an opening where the lipstick emerges, and a means for attachment of the tube to a wearable accessory thereby forming a union comprising the tube and the wearable accessory wherein the accessory comprises a necklace, a pendant, or a brooch and wherein the means for attachment comprises at least one clasp or at least one coupling located at the tube to disconnect and reconnect the union and wherein the positions of the clasp or coupling attachment to the tube determine the tube orientation with respect to the body of a wearer and wherein the tube orientation assumes a vertical position when the clasp or the coupling attachment is located at one end of the tube, or a horizontal position when the clasp or the coupling attachment is located at both tube ends or positioned in the tube center;

wherein the coupling comprises an adapter having two connection interphases, one for the connection with the tube and the other for the connection to the necklace or to an appendage on the necklace and wherein connectivity between the tube and adapter is achieved by means comprising clasps or grip-tape interphases, and wherein connection between adapter and the necklace or the appendage is achieved by means comprising matching magnetic inserts at the surfaces of the adapter terminus and at the necklace pendant, or matching clasp elements, or matching groove and tongue elements complementary to the necklace or appendage.

8. The lipstick tube of claim 7 wherein the adapters are sets of matching pairs to enable horizontal tube positions at the necklace.

* * * * *